US006401689B1

(12) United States Patent
Ito et al.

(10) Patent No.: US 6,401,689 B1
(45) Date of Patent: Jun. 11, 2002

(54) ELECTRIC THROTTLE-CONTROL APPARATUS AND MOTOR USED FOR THE APPARATUS

(75) Inventors: Masaru Ito, Hitachinaka; Shinichi Fujino, Mito; Hisaya Shimizu, Hitachinaka; Yoshinori Fukasaku, Hitachinaka; Masahiro Hiruta, Hitachinaka; Takashi Yokoyama, Hitachinaka, all of (JP)

(73) Assignees: Hitachi, Ltd., Tokyo; Hitachi Car Engineering Co., Ltd., Hitachinaka, both of (JP)

( * ) Notice: Subject to any disclaimer, the term of this patent is extended or adjusted under 35 U.S.C. 154(b) by 11 days.

(21) Appl. No.: 09/606,905

(22) Filed: Jun. 30, 2000

(30) Foreign Application Priority Data

Jun. 30, 1999 (JP) ..... 11-185787

(51) Int. Cl.[7] ..... F02D 9/10; H01R 39/32; H01R 39/60

(52) U.S. Cl. ..... 123/399; 310/233; 310/248

(58) Field of Search ..... 123/399; 310/233, 310/248

(56) References Cited

U.S. PATENT DOCUMENTS 3,786,287 A * 1/1974 Stein ..... 310/233
4,596,159 A * 6/1986 Hamano et al. ..... 310/248
5,825,114 A * 10/1998 Mukai ..... 310/248
5,828,193 A * 10/1998 Furuta ..... 123/399
5,994,815 A * 11/1999 Takagi et al. ..... 310/233

FOREIGN PATENT DOCUMENTS

| | | |
|---|---|---|
| JP | 2-500677 | 3/1990 |
| JP | 5-336719 | 12/1993 |
| JP | 7-72503 | 8/1995 |
| JP | 10-174403 | 6/1998 |
| JP | 10-184401 | 7/1998 |
| JP | 10-248226 | 9/1998 |
| JP | 10-274060 | 10/1998 |

* cited by examiner

*Primary Examiner*—Erick Solis
(74) *Attorney, Agent, or Firm*—Crowell & Moring LLP

(57) ABSTRACT

In an electric throttle-control apparatus for controlling an open position of a throttle valve 6 connected to reduction gears 47 to reduce rotational speed of the motor 4, by driving a motor 4 which includes a commutator 32 with a plurality of slots 44, and brushes 31 and 31', the number of the slots in the commutator and the arrangement of brushes on the slots are set such that even and odd number slot states appear alternately in an electrical equivalent-circuit of a wire-connection among slots including the brushes while the motor rotates. Further, if the number of the slots 44 is the odd number 9, 11, or 13, the brushes 31 and 31' are arranged in a 180° opposed placement, and if the number of the slots 44 is the even number 10 or 12, the brushes 31 and 31' are arranged in a non-opposed placement shifted from a 180° opposed placement.

14 Claims, 23 Drawing Sheets

180° OPPOSED PLACEMENT OF BRUSHES (180 ± 360/2n)° NON-OPPOSEDPLACEMENT OF BRUCHES

FIG. 24

| NUMBER n | 180° OPPSED PLACEMENT | (180±360/2n)° NON-OPPOSED PLACEMENT |
|---|---|---|
| 8 | ⟨WITH BRUSHE'S STRADDLE BEWEEN SLOTS⟩ 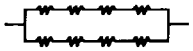 ⟨WITHOUT BRUSHE'S STRADDLE BEWEEN SLOTS⟩ 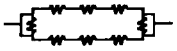 | ⟨WITH BRUSHE'S STRADDLE BEWEEN SLOTS⟩ THE SAME AS THE LEFT CIRCUIT ⟨WITHOUT BRUSHE'S STRADDLE BEWEEN SLOTS⟩ 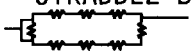 |
| 9 | ⟨WITH BRUSHE'S STRADDLE BEWEEN SLOTS⟩ 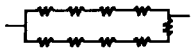 ⟨WITHOUT BRUSHE'S STRADDLE BEWEEN SLOTS⟩ 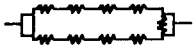 | — |
| 10 | ⟨WITH BRUSHE'S STRADDLE BEWEEN SLOTS⟩ 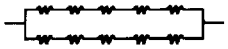 ⟨WITHOUT BRUSHE'S STRADDLE BEWEEN SLOTS⟩ 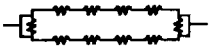 | ⟨WITH BRUSHE'S STRADDLE BEWEEN SLOTS⟩ THE SAME AS THE LEFT CIRCUIT ⟨WITHOUT BRUSHE'S STRADDLE BEWEEN SLOTS⟩ 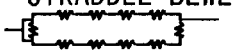 |
| 11 | ⟨WITH BRUSHE'S STRADDLE BEWEEN SLOTS⟩ 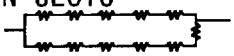 ⟨WITHOUT BRUSHE'S STRADDLE BEWEEN SLOTS⟩ 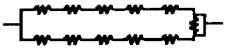 | — |
| 12 | ⟨WITH BRUSHE'S STRADDLE BEWEEN SLOTS⟩ 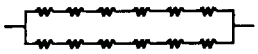 ⟨WITHOUT BRUSHE'S STRADDLE BEWEEN SLOTS⟩ 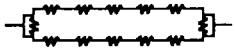 | ⟨WITH BRUSHE'S STRADDLE BEWEEN SLOTS⟩ THE SAME AS THE LEFT CIRCUIT ⟨WITHOUT BRUSHE'S STRADDLE BEWEEN SLOTS⟩ 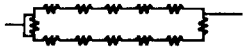 |
| 13 | ⟨WITH BRUSHE'S STRADDLE BEWEEN SLOTS⟩ 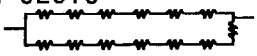 ⟨WITHOUT BRUSHE'S STRADDLE BEWEEN SLOTS⟩ 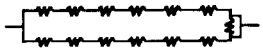 | — |

ELECTRIC THROTTLE-CONTROL APPARATUS AND MOTOR USED FOR THE APPARATUS

BACKGROUND OF THE INVENTION

The present invention relates to an electric throttle-control apparatus and a motor used in the apparatus.

In a conventional throttle system used in a car, since the throttle system is mechanically composed such that the throttle valve is opened and closed according to the operation of an acceleration pedal via a wire, the quantity of the pedal-operation directly corresponds to the open degree of the throttle valve. Recently, a highly accurate control of a throttle valve has been required from the view points of the regulations to exhaust gas, and improvements for fuel consumption, safety, and salability, and the electrical throttle-control system (hereafter referred to as an ETC system).

As shown in FIG. 26, National Publication of Japanese-translated version Hei-500677 (WO88/02064) discloses an apparatus for electrically controlling intake air flowing into an internal combustion engine: the apparatus including an intake air flow path 10, a throttle valve 11 fixed to a rotatably set shaft 12 located in the intake air flow path 10, and a first return spring 15, which is always engaged with the shaft 12, for applying a torque in the direction of closing the throttle valve 11. Further, the throttle valve 11 is guided by the return spring 15 to the stop position of the minimum open angle $\alpha_r$ (>0) toward the stopper to which a spring-load is applied by an opposing spring 21. In addition, a rotation-adjusting unit 13, in which a motor is used, is controlled so as to generate torque, corresponding to torque to open the throttle valve 11 to the maximum open angle.

Also, as shown in FIG. 27, Japanese Patent Publication Hei 7-72503 discloses a load-adjusting apparatus including a control element 11 connected to a transmission member 4 further connected to an acceleration pedal 1, which acts on a throttle valve 16 in an internal combustion engine, and on the electrical servo-driving unit 9 along with a target operation amount-detection element 7 attached to the transmission element 4. Further, the control element includes an actual operation amount-detection element 12, and the electrical servo-driving unit 9 is controlled by an electric control apparatus 22 based on the detected operation amount. Furthermore, the control element 11, the target operation amount-detection element 7, the actual operation amount-detection element 12, and the servo-driving unit 19 are arranged in a throttle valve casing 24. Moreover, the control element 11 is connected to the transmission member 4 with a connection spring 13 so as to be pressed toward a stopper 14 attached to the transmission member 4.

Generally, when a motor receives voltage, and begins to rotate, voltage in the direction reverse to that of the received voltage is generated in the motor, due to the generation effect of the motor. This generated voltage is called a counter voltage, and is proportional to the rotational speed of the motor. Since the motor used in an electric throttle-control apparatus is controlled to rotate to the target rotational position, when the rotation approaches the target rotational position, voltage in the direction reverse to that of the rotation of the motor is applied to the motor due to the deceleration. Thus, the counter voltage is superimposed on the fed voltage, which in turn may cause an over-current flow in the motor.

In a conventional motor, the resistance of the motor is adequately set such that an over-current due to the counter voltage does not flow in the motor. Thus, the amount of current flowing in the motor and the motor-drive circuit is suppressed below a permissible level of current for the elements in the motor-drive circuit.

However, in controlling the throttle-valve position with a motor, the throttle-valve position becomes less than stable due to small fluctuations in the torque generated within the motor, these in turn appearing as fluctuations in the rotational speed of the engine. These fluctuations of the rotational speed are not only visually perceived as fluctuations of the needle on the speed meter, but are also audibly perceived. Particularly, fluctuations in idling has been a great problem.

Since the design specification regarding the deviation in torque of a motor has been prescribed by the deviation in the average torque of the motor, it has been difficult to sufficiently suppress the fluctuation of the engine rotational speed even if the motor satisfies the design specification.

This problem has been handled by implementing proper control-characteristics of an engine-control unit whose control parameters are optimally set by a parameter survey method.

However, in its execution, since it is necessary to determine an optimal control parameter set for each electronic throttle-control apparatus in which a different motor is used, this parameter survey method is not flexible.

SUMMARY OF THE INVENTION

The present invention has been achieved with consideration to the above problems, and is aimed at providing an electric throttle-control apparatus which can suppress the fluctuations of the engine rotational speed to below a small level, and especially the fluctuations in idling, by decreasing the change in the torque generated between slots of the motor used in the electric throttle-control apparatus without adjusting a control parameter set of the engine control unit. More specifically speaking, the present invention is aimed at providing a motor such that the fluctuations of the rotational speed can be suppressed to below the level of 3% (15 rpm), which cannot be visually and audibly perceived, assuming that the idling rotational-speed is 500 rpm.

As a result of the inventors' searching and analyzing malfunctions in electric throttle-control apparatuses, it has been found that employing the average torque of a motor to suppress torque fluctuation of the motor is not adequate, and clarification of the motor's behavior during the brush's transition between slots is important. That is, it has been noticed that the torque fluctuations caused during the brush's transition between slots must be suppressed to improve responses of a motor for demands of Small Step-changes in torque.

The present invention provides the following apparatuses, motors, and internal combustion engines used in an electric throttle-control, which can improve responses of a motor for demands of Small Step-changes in torque.

To achieve the above objective, the present invention provides a first electric throttle-control apparatus, which includes a motor, a speed-reduction mechanism for reducing rotational speed of the motor, and a throttle valve connected to the speed-reduction mechanism, for controlling an open position of the throttle valve by driving the motor, wherein the motor includes a commutator with a plurality of slots, and brushes; and the number of the slots in the commutator and the arrangement of brushes on the slots are set so that even and odd number slot states appear alternately in an electrical equivalent-circuit of a wire-connection among slots including the brushes while the motor rotates.

Further, the present invention provides a second electric throttle-control apparatus such that, in the above first electric throttle-control apparatus, the number of the slots of the commutator is one of odd numbers 9, 11, and 13; the number of the brushes is 2; and the brushes are arranged in a 180° opposed placement.

Furthermore, the present invention provides a third electric throttle-control apparatus such that, in the second electric throttle-control apparatus, the number of the slots of the commutator is one of odd numbers 9 and 11.

Moreover, the present invention provides a fourth electric throttle-control apparatus such that, in the first electric throttle-control apparatus, the number of the slots of the commutator is one of even numbers 10 and 12; the number of the brushes is 2; and the brushes are arranged by shifting their positions from a 180° opposed placement.

Also, the present invention provides a fifth electric throttle-control apparatus such that, in the fourth electric throttle-control apparatus, the brushes are arranged in a (180–360/2n)° non-opposed placement, where n is the number of the slots of the commutator.

In addition, the present invention provides a sixth electric throttle-control apparatus such that, in the fifth electric throttle-control apparatus, brush holders for holding the respective slots are arranged in a 180° opposed placement.

Also, the present invention provides a seventh electric throttle-control apparatus such that, in one of the first, second, and fourth electric throttle-control apparatuses, representing the width of each brush and the peripheral pitch between slots with symbols b and c, respectively, the ratio b/c is set to a value equal to or less than 1.

Further, the present invention provides an eighth electric throttle-control apparatus, which includes a motor, a speed-reduction mechanism for reducing rotational speed of the motor, and a throttle valve connected to the speed-reduction mechanism, for controlling an open position of the throttle valve by driving the motor, wherein the motor includes a commutator with a plurality of slots, and two brushes; and a relative variation of engine rotational-speed is suppressed to within 3% by setting the number of the slots to one of odd numbers 9, 11, and 13, and arranging the two brushes in a 180° opposed placement.

Furthermore, the present invention provides a ninth electric throttle-control apparatus, which includes a motor, a speed-reduction mechanism for reducing rotational speed of the motor, and a throttle valve connected to the speed-reduction mechanism, for controlling an open position of the throttle valve by driving the motor, wherein the motor includes a commutator with a plurality of slots, and two brushes; and a relative variation of engine rotational-speed is suppressed to within 3% by setting the number of the slots to one of even numbers 10 and 12, and arranging the two brushes in a non-opposed placement shifted from a 180° opposed placement.

Moreover, the present invention provides a first motor used for an electric throttle-control apparatus, including a commutator with a plurality of slots, and two brushes, wherein a relative variation of engine rotational-speed is suppressed to within 3% by setting the number of the slots to one of odd numbers 9, 11, and 13, and arranging the two brushes in a 180° opposed placement.

Further, the present invention provides a second motor such that, in the first motor, the number of the slots is one of odd numbers 9 and 11.

Also, the present invention provides a third motor used for an electric throttle-control apparatus, including a commutator with a plurality of slots, and two brushes, wherein a relative variation of engine rotational-speed is suppressed to within 3% by setting the number of the slots to one of even numbers 10 and 12; and the two brushes are arranged in a non-opposed placement shifted from a 180° opposed placement.

Further, the present invention provides a first internal combustion engine using one of the first, second, fourth, eighth, and ninth, and electric throttle-control apparatuses.

Furthermore, the present invention provides a second internal combustion engine including an electric throttle-control apparatus in which one of the first, second, and third motors is used.

BRIEF DESCRIPTION OF THE DRAWINGS

FIG. 24 is a diagram showing electrical equivalent-circuits of respective armatures for various numbers of slots, with or without each brush's straddle between slots.

DETAILED DESCRIPTION OF THE EMBODIMENTS

Hereafter, the embodiments will be explained in detail with reference to the drawings.

Figure 1:
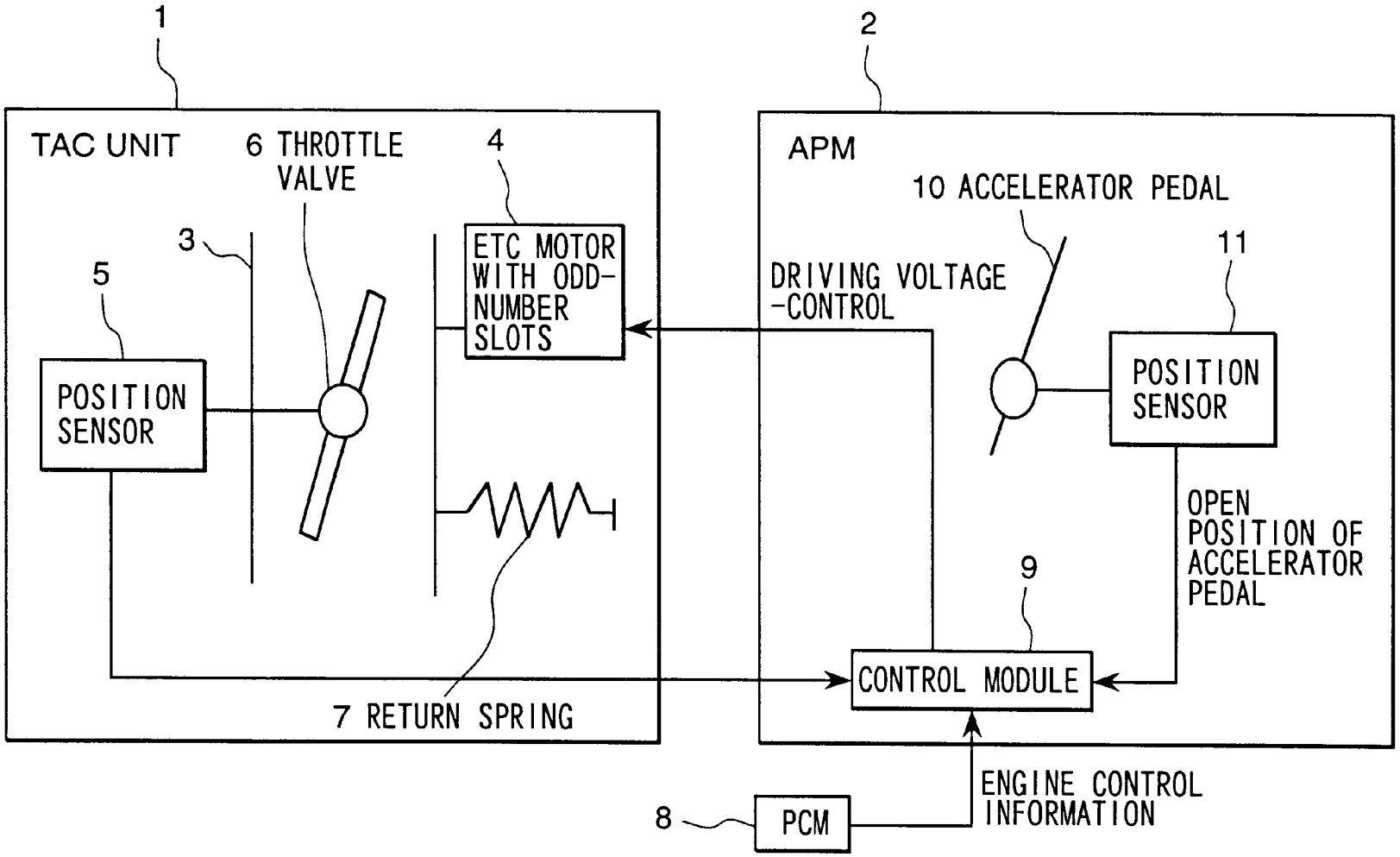
FIG. 1 is an illustration showing the schematic composition of an electric throttle-control (ETC) apparatus of an embodiment according to the present invention.

FIG. 1 shows the schematic composition of an electric throttle-control (ETC) apparatus of an embodiment according to the present invention. The ETC apparatus includes a TAC Throttle Actuator Control unit) 1, an APM (Accelerator Pedal Mechanism) 2, and a return spring. Further, the TAC 1 includes a DC motor 4 with odd number slots (hereafter referred to as an ETC motor), which is provided at a throttle body 3, a gear mechanism not shown in this figure, and a position sensor 5. Also, the APM 2, which is connected to a PCM (Power Train Control Module) 8, includes a control module 9 to which the open position of an accelerator pedal and information on the engine control are input from a position sensor 11 and the PCM 8, respectively, for performing control processing based on the open position of a throttle valve 6 sent from the position sensor 5 and the open position of the accelerator pedal 10 sent from the position sensor 11. The control module 9 controls the ETC motor 4 by controlling the drive voltage of the motor 4. The APM 2 drives the ETC motor 4 to control the opening and closing of the throttle valve 6, by performing a feed-back control such as to optimize the amount of intake air, using the open position of the accelerator pedal 10, the engine rotational speed, the temperature of coolant, and the actual open position of the throttle valve 6 detected by the position sensor 5.

Figure 2:
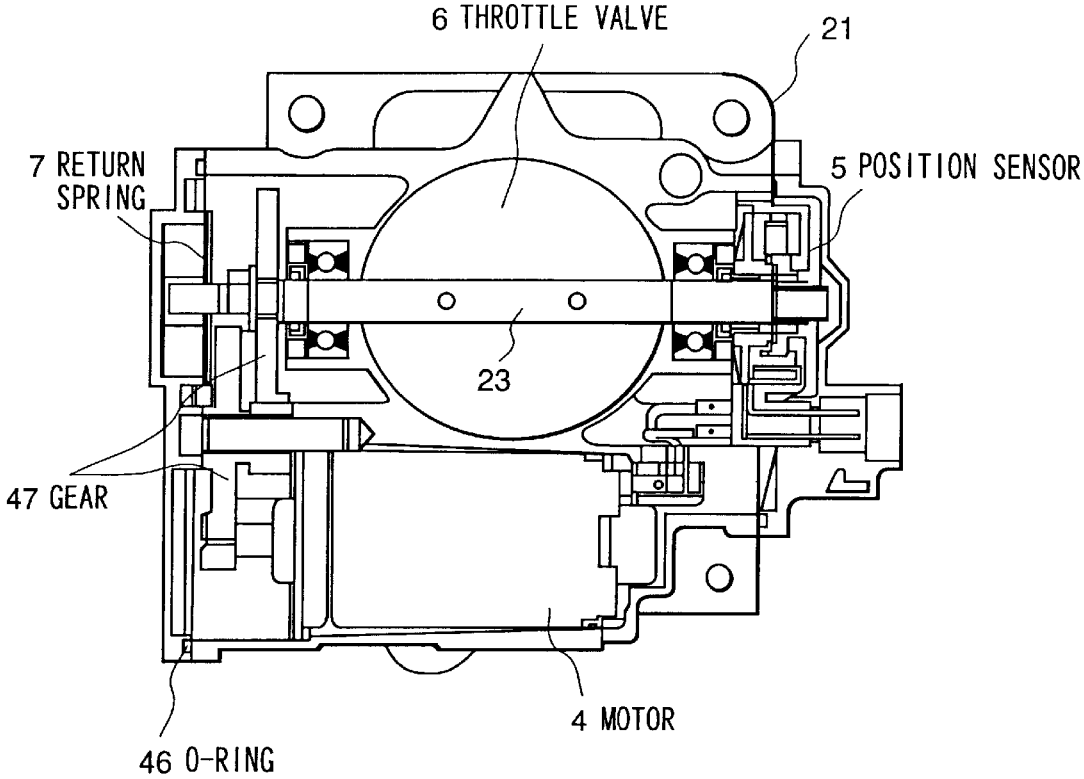
FIG. 2 is a vertical cross section showing the composition of a throttle actuator control (TAC) unit used in the ETC apparatus.

FIG. 2 shows a vertical cross section of the throttle actuator control (TAC) unit 2 used in the ETC apparatus.

The ETC motor 4 is contained in a casing 21 of the TAC 1, and shielded with an o-ring 46 from water or dust in the outside air. Further, the ETC motor 4 is located at the side of the throttle valve 6 in parallel with a rotating shaft 23 of the throttle valve 6, and is also connected to the rotating shaft 23 via two gears 47. Furthermore, a return spring 7 is attached to the throttle valve 6, and the spring force of the spring 7 is set in the direction of closing the throttle valve 6 to hold at a predetermined open position of the throttle valve 6. This spring force is applied to the ETC motor 4 as a load torque.

The position sensor 5 for detecting the actual open position of the throttle valve 6 is located in the casing 23 of the TAC 1.

In the above mechanism, the throttle valve 6 is opened and closed only by the ETC motor 4, and if the ETC motor falls in an anomalous state, since the throttle valve 6 is rotated by the return spring 7 in the direction of closing the valve 7, the output excursion of the engine can be suppressed.

Figure 3:
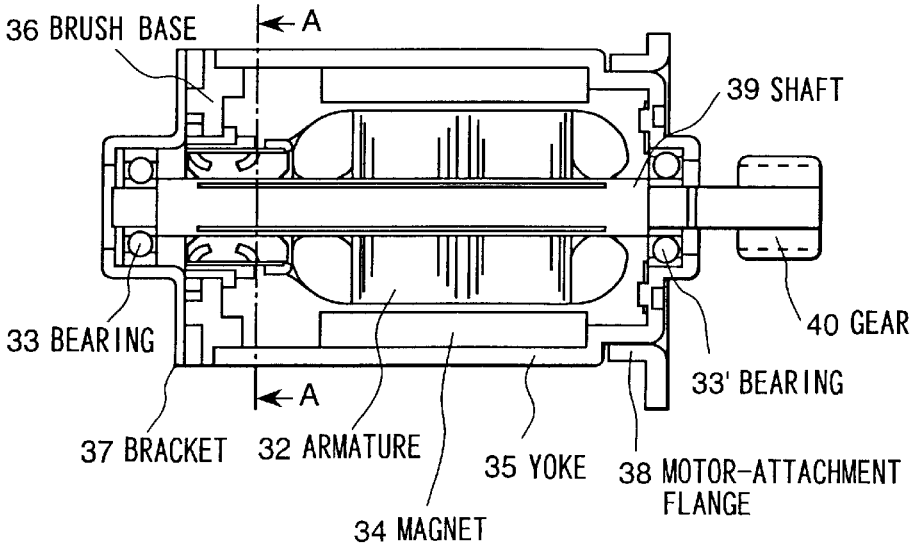
FIG. 3 is a vertical cross section showing the composition of a motor of the embodiment used in the ETC apparatus.
Figure 4:
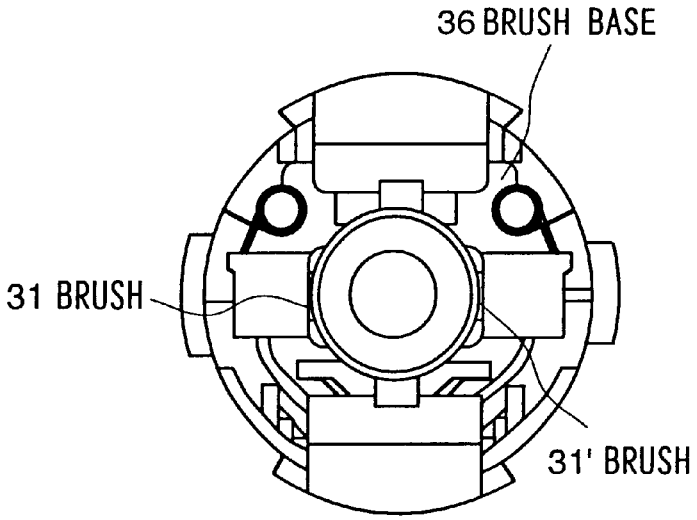
FIG. 4 is an elevational view of the motor shown in FIG. 3, viewed from the line A—A in FIG. 3.

FIG. 3 shows a vertical cross section of the composition of the ETC motor 4, and FIG. 4 shows an elevational view of the motor 4 shown in FIG. 3, viewed from the line A—A in FIG. 3. The ETC motor 4 is a small size DC magnet-type motor with a pair of brushes 31 and 31', and includes an armature 32 of a rotating part, bearings 33 and 33' for supporting the armature 32, a yoke 35 for fixing a magnet 34 with an adhesive agent, a brush base 36 made of thermo-setting resin (phenol), and a bracket 37 fixed to the yoke 35 with caulking. The motor 4 is attached to the TAC unit by fixing the motor 4 to an attachment flange 38 connected to the yoke 35 with welding. Further, the drive force of the motor 4 is transmitted to the throttle valve 6 via gears 40 pressed to the top of a shaft 39.

The TAC unit to which the ETC motor 4 is attached is directly attached to the upper part of the engine via an intake manifold.

Figure 5:
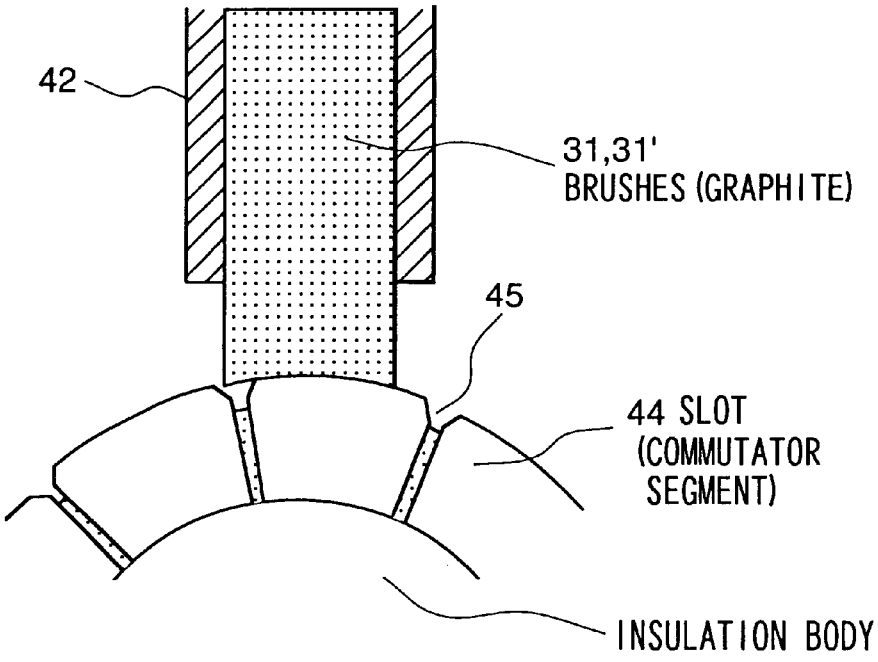
FIG. 5 is an illustration showing the arrangement of slots and one of the brushes in the motor.
Figure 6:
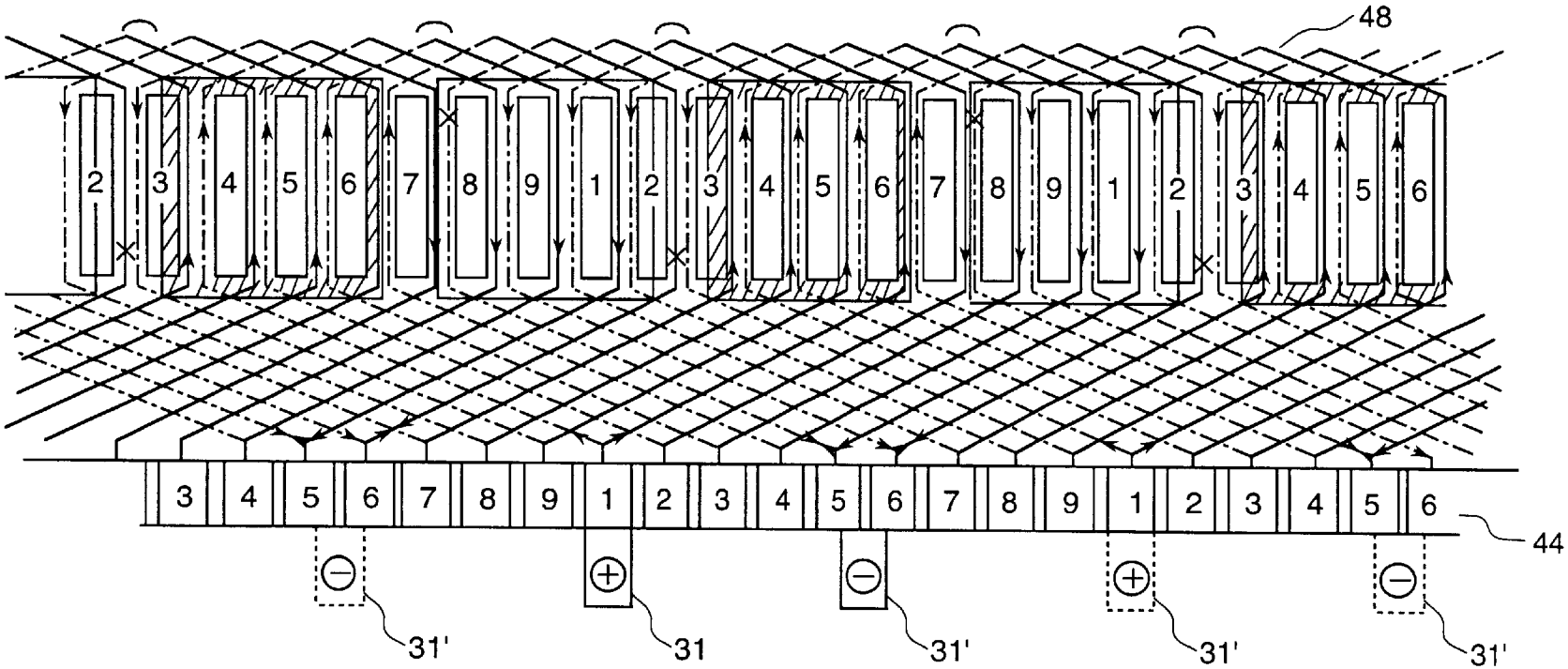
FIG. 6 is a wire-connection diagram in an armature in the composition where the number of slots is nine, and respective brushes are located in the 180° opposed placement.
Figure 7:
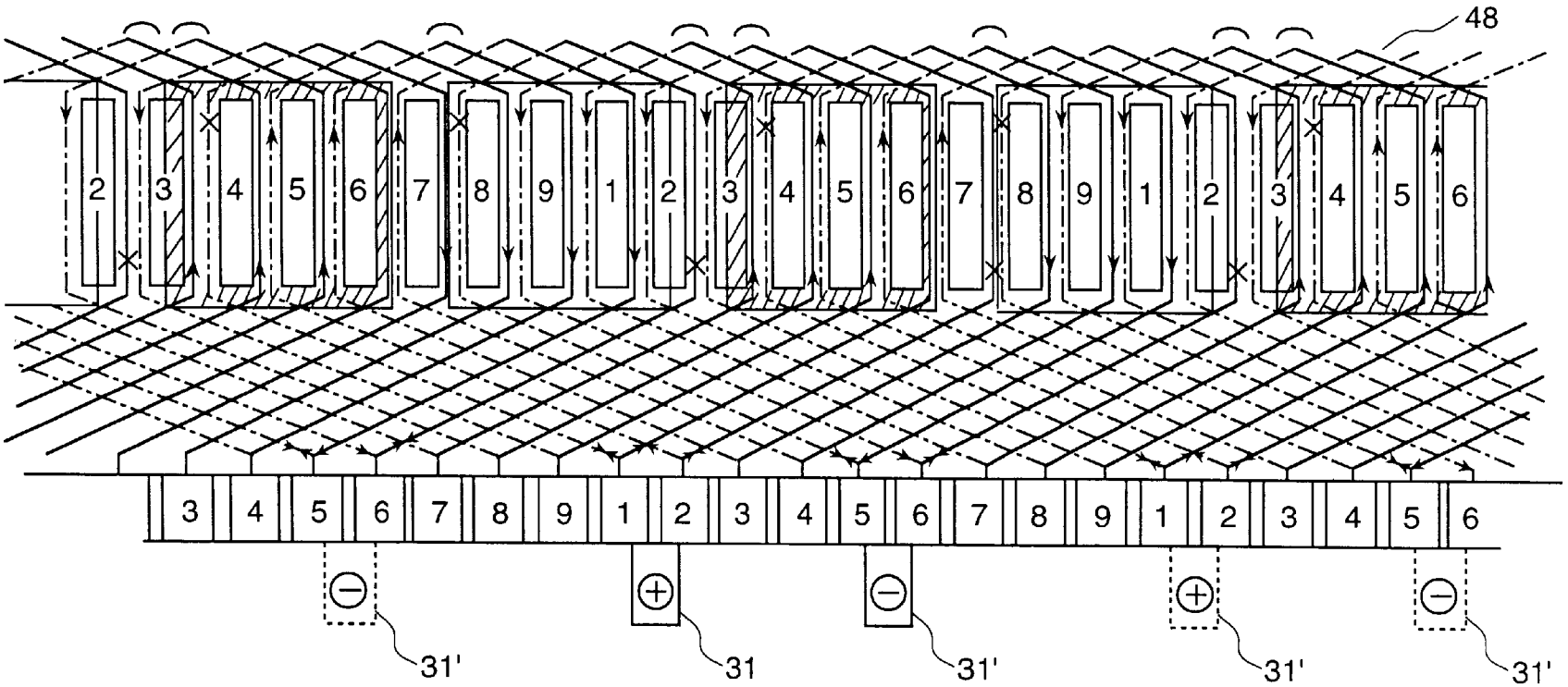
FIG. 7 is a wire-connection diagram in the armature when each brush shorts the neighboring two slots in the composition shown in FIG. 6.

The structure of a commutator with slots (commutator segments) such as that shown in FIG. 5 is applied to the commutator used in the present invention. As shown in FIG. 5, the slots 44, which are usually made of Cu, are fixed to a resin member 41 made of insulation material, and the number of the slots 44 is, for example, nine. In the case when the number is nine, nine gaps are formed among the slots 44. Further, a pair of brushes 31 and 31' are arranged on the slots 44 in a 180° opposed placement. The pair of brushes 31 and 31' are held by brush holders 42. In the above composition of the armature 32, the relationship among the brushes 31 and 31', the slots 44, and a coil 48 is shown in FIG. 6 and FIG. 7. The wire-connection shown in these figures is well-known.

Figure 8:
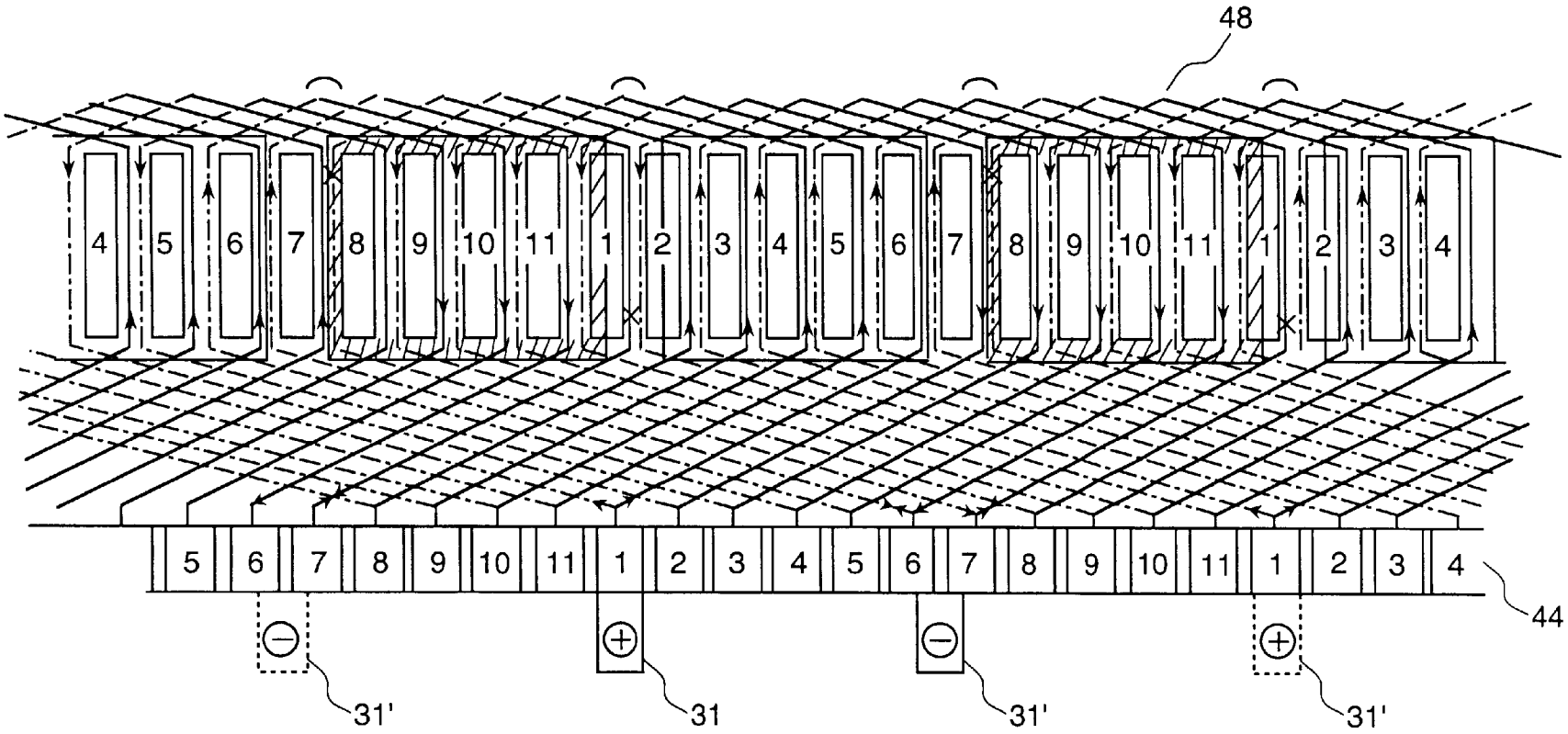
FIG. 8 is a wire-connection diagram in an armature in the composition where the number of slots is eleven, and respective brushes are located in the 180° opposed placement.
Figure 9:
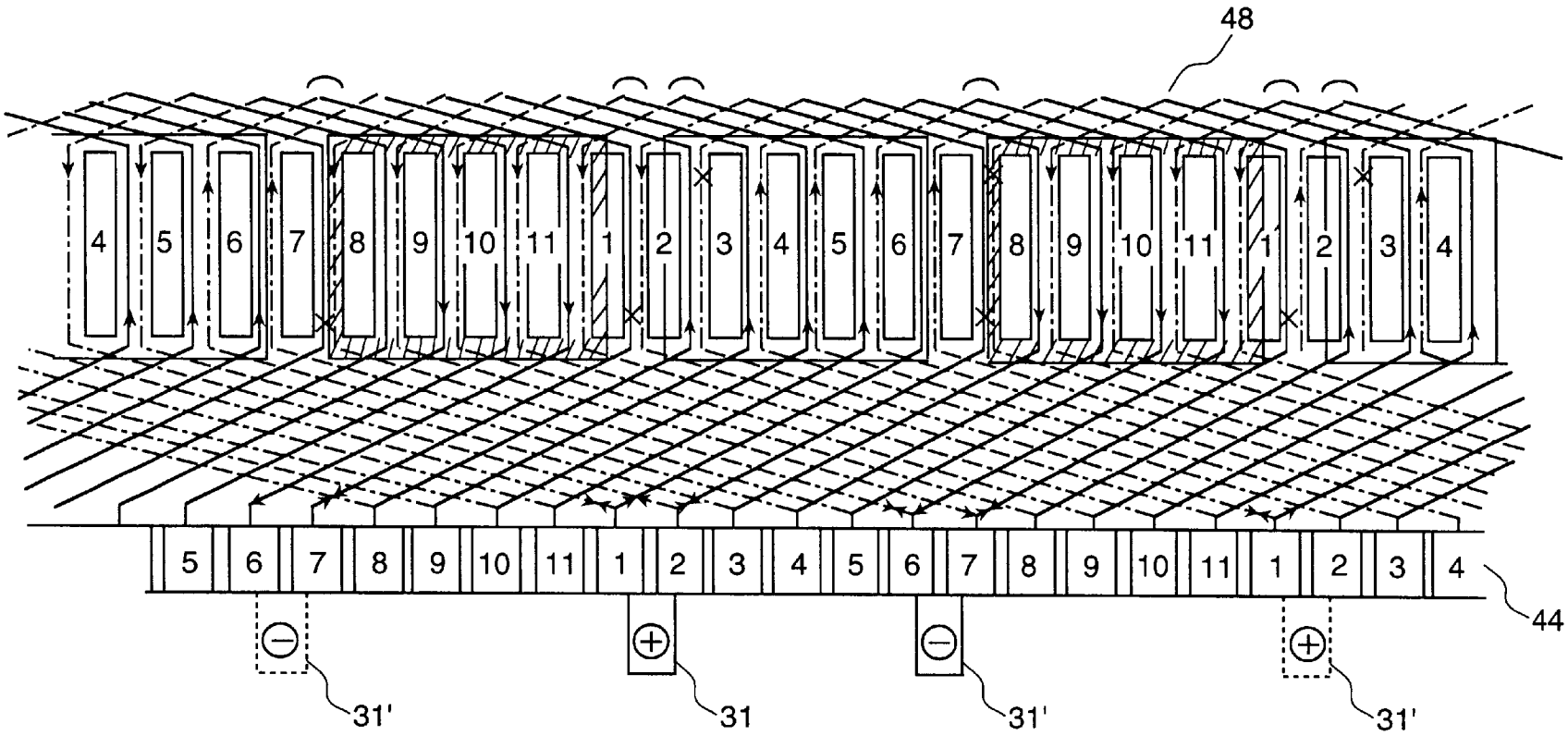
FIG. 9 is a wire-connection diagram in the armature when each brush shorts the neighboring two slots in the composition shown in FIG. 8.

FIG. 8 shows a wire-connection diagram in an armature 32 in the composition where the number of slots 44 is eleven, and the respective brushes 31 and 31' are located in the 180° opposed placement, and FIG. 9 shows a wire-connection diagram when each brush shorts the neighboring two slots in the composition shown in FIG. 8. The wire-connections shown in these figures are also well-known.

The output torque of the DC motor 4 is expressed by the following equation.

$$T=K\cdot Z\cdot\phi\cdot Ia \quad (1),$$

where T: the output torque, K: a torque constant, Z:, $\phi$: the whole magnetic flux, and Ia: current viewed from the terminals.

Since Z and $\phi$ in the equation (1) are approximately constant, the variation $\Delta T$ of torque is proportional to the variation $\Delta Ia$, that is: $\Delta T \quad \Delta Ia$.

Accordingly, $$\Delta Ia=e/(\Delta R+\Delta L)\approx e/\Delta R \quad (2),$$

where "e" is the applied voltage.

Here, a very important fact has been found by the inventors. That is, whether or not the number of slots in an electrical equivalent-circuit changes alternately from an even number to an odd number, or from an odd number to an even number when each brush transits from one slot to the neighboring slot, greatly affects the variation $\Delta T$ of torque (not the average variation of torque). Further, it has been found that the relative variations of $\Delta T$ to an average torque value Tnom in steady state, change depending the number of the slots shown in Table 1.

TABLE 1

(The relative variation of torque)

| The number of slots | ΔT/Tnom (%) The brush placement: 180° opposed placement |
|---|---|
| 6 | 20.0 |
| 7 | 6.67 |
| 8 | 14.29 |
| 9 | 5.26 |
| 10 | 11.11 |
| 11 | 4.35 |
| 12 | 9.09 |
| 13 | 4.00 |

Figure 22:
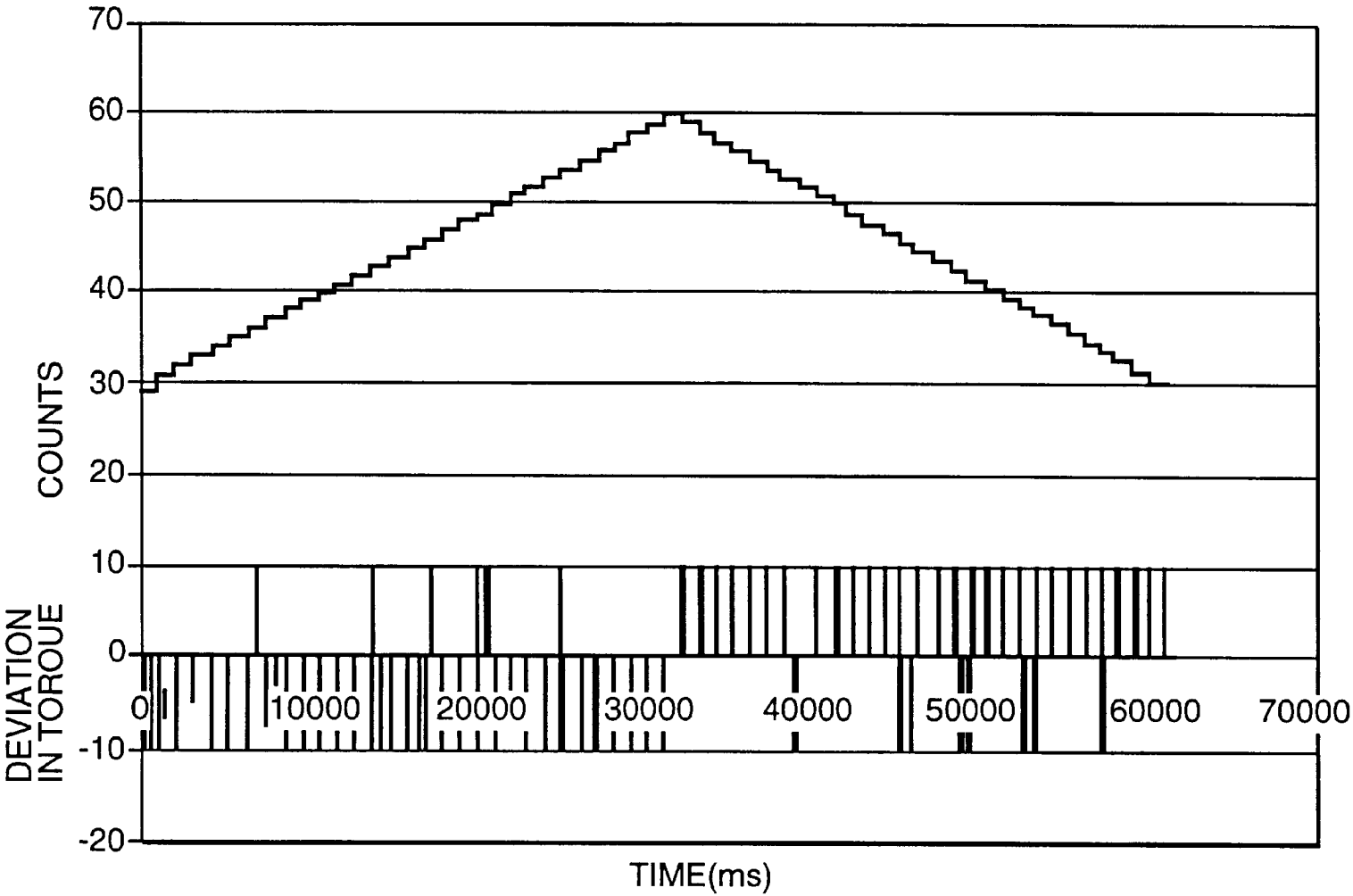
FIG. 22 is a graph showing the responses for demands of Small Step-changes in torque, of a motor which is controlled by an engine control unit.
Figure 23:
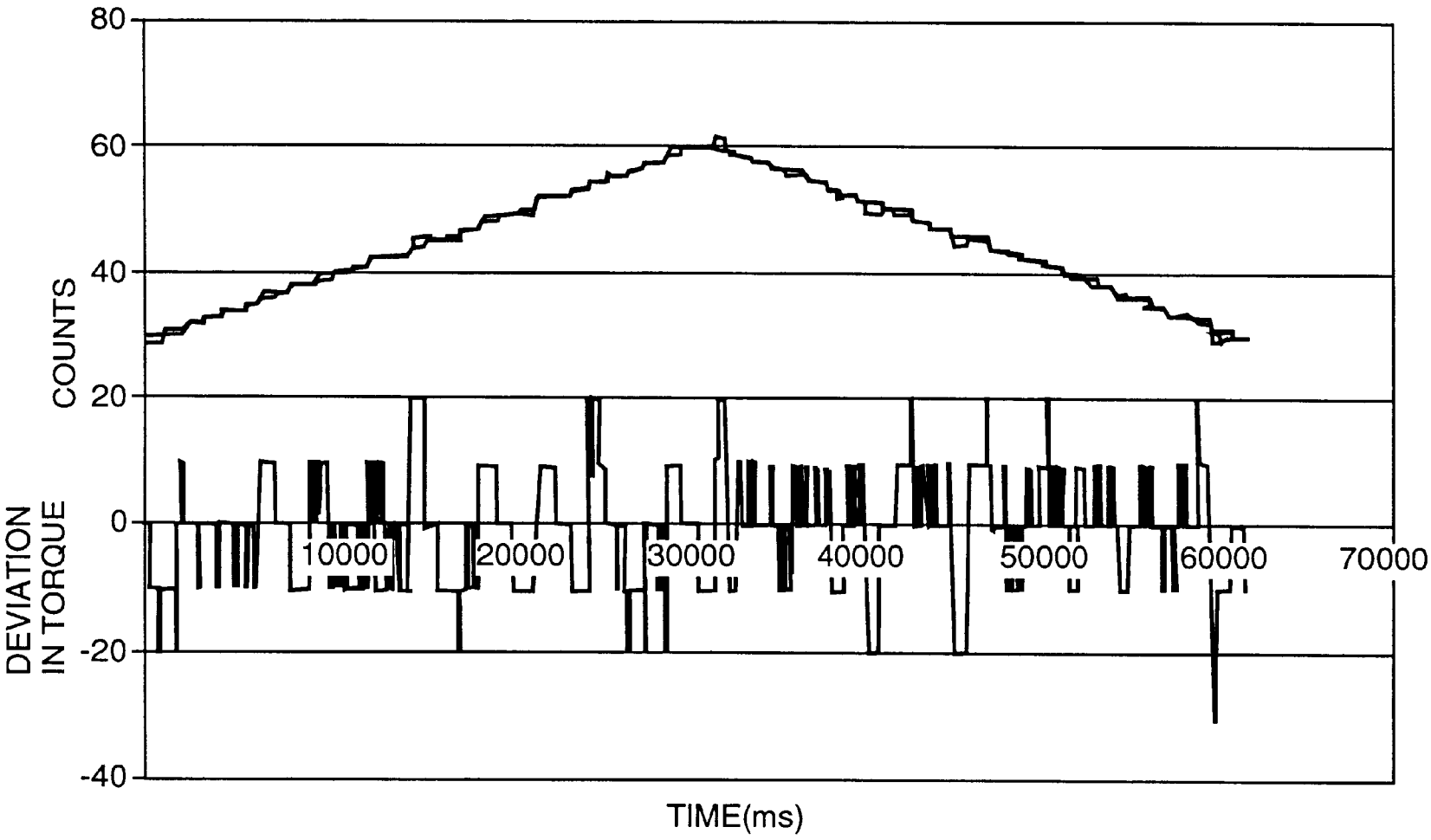
FIG. 23 is a graph showing the responses for demands of Small Step-change in torque, of a motor which is not controlled by an engine control unit.

In two example cases, the changes in driving counts of the control variable for driving the throttle valve 6, and the deviation of torque to the driving counts, are shown in FIG. 22 and FIG. 23, respectively. FIG. 2 shows the change in driving counts, and the deviations of torque, in the case when the output torque of the motor 4 is adjusted by an engine control unit. It is shown in FIG. 23 that the deviations in torque in the case when the output torque of the motor 4 is not adjusted by and engine control unit, are larger than those in the case shown in FIG. 22. The reason why the deviations of torque in the case when the output torque of the motor 4 is not adjusted become large, is explained as follows. The transition motion of each brush, between any two neighboring slots, is usually controlled by 30–60 driving counts, and one driving count corresponds to 0.1 deg. of the opening degree of the throttle valve 6. Assuming that the gear ratio is 20.5, and the transition motion between any two neighboring slots is controlled by 30 driving counts, the rotation angle of the motor 4 controlled by 30 driving counts is the following value:

30 driving counts 0.1 deg.20.5=61.5 deg.

Provided that the number of the slots is set to 10, since the rotation angle per one slot is 36 deg., the number of slots corresponding to the rotation angle 61.5 deg. of the motor 4, which is controlled by 30 driving counts, is the following value:

61.5 deg./36 deg.≈1.7 slots.

Therefore, the variation of ΔR, namely ΔIa, in the transition motion between two slots, is an important factor for the variation of torque. The countermeasure to the fluctuations of torque based on the change in the average value of torque is not useful because of the above-described fact.

From Table 1, it is seen that using an armature with odd-number slots can suppress the relative variation of torque less than that in using an armature with even-number slots. Thus, it is proved that the number of the slots must be selected to be odd. Next, a flexible countermeasure which can further suppress the relative variation of torque to within 3% is investigated below.

Under the condition of 500 rpm in an idling operation, selecting the slot number of 7 results in the relative torque-variation of 6.67 which corresponds with the rotational speed-variation of 3.4%, and cannot solve the above subject. Selecting the slot number of 9, 11, or 13 results in the rotational speed-variation of within 3%, and can solve the above subject. A motor with slots equal to, or more than 15, should not be used from the view of production costs. The above selecting of the slot number of 9, 11, or 13 can be adaptable for use of any sized motor.

Although the selecting of the odd slot-number can solve the subject, a method for realizing the same effect as that obtained by the motor with the odd slot-number when using a motor with slots of an even number is described below.

Figure 10:
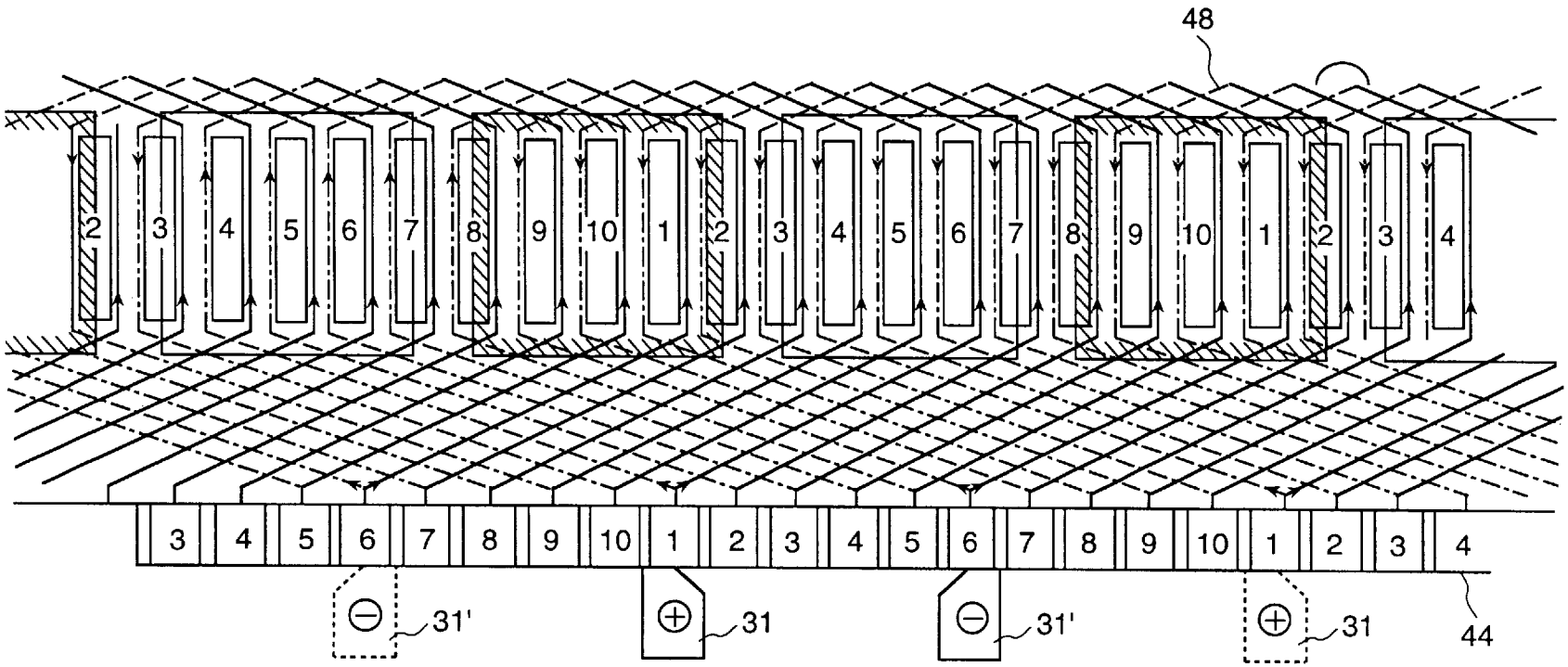
FIG. 10 is a wire-connection diagram in an armature in the composition where the number of slots is nine, and respective brushes are located in the (180–18)° non-opposed placement.
Figure 11:
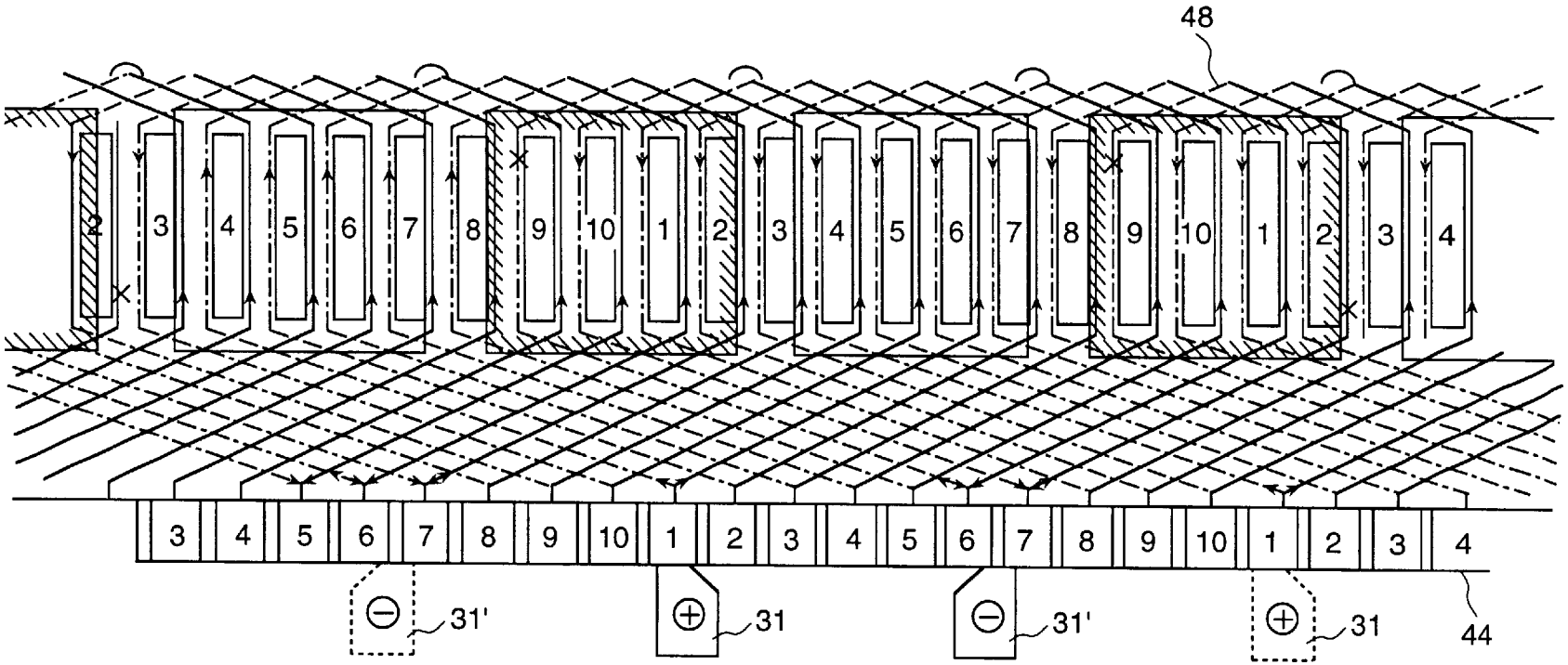
FIG. 11 is a wire-connection diagram in the armature when each brush shorts the neighboring two slots in the composition shown in FIG. 10.
Figure 18:
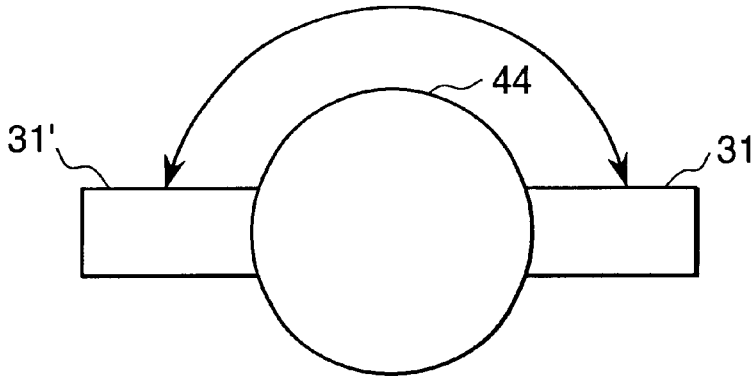
FIG. 18 is an illustration showing the 180° opposed placement of the brushes.

Fist, the placement of the brushes 44 is investigated. In an embodiment for the even slot-number, the brush placement is changed from the 180° opposed placement such as that shown in FIG. 18 to the non-opposed placement such as that shown in FIG. 19. That is, the pair of the slots 44 is arranged in the (180–360/2n)° non-opposed placement, where "n" indicates the slot number. In the case when the above replacement of the slots 44 is adopted for the motor 4 with ten slots in the armature 32, the wire-connection diagrams are shown in FIG. 10 and FIG. 11. As shown in FIG. 11, in the state with the brush's straddling two slots, the number of slots in the electrical equivalent-circuit becomes nine.

Figure 12:
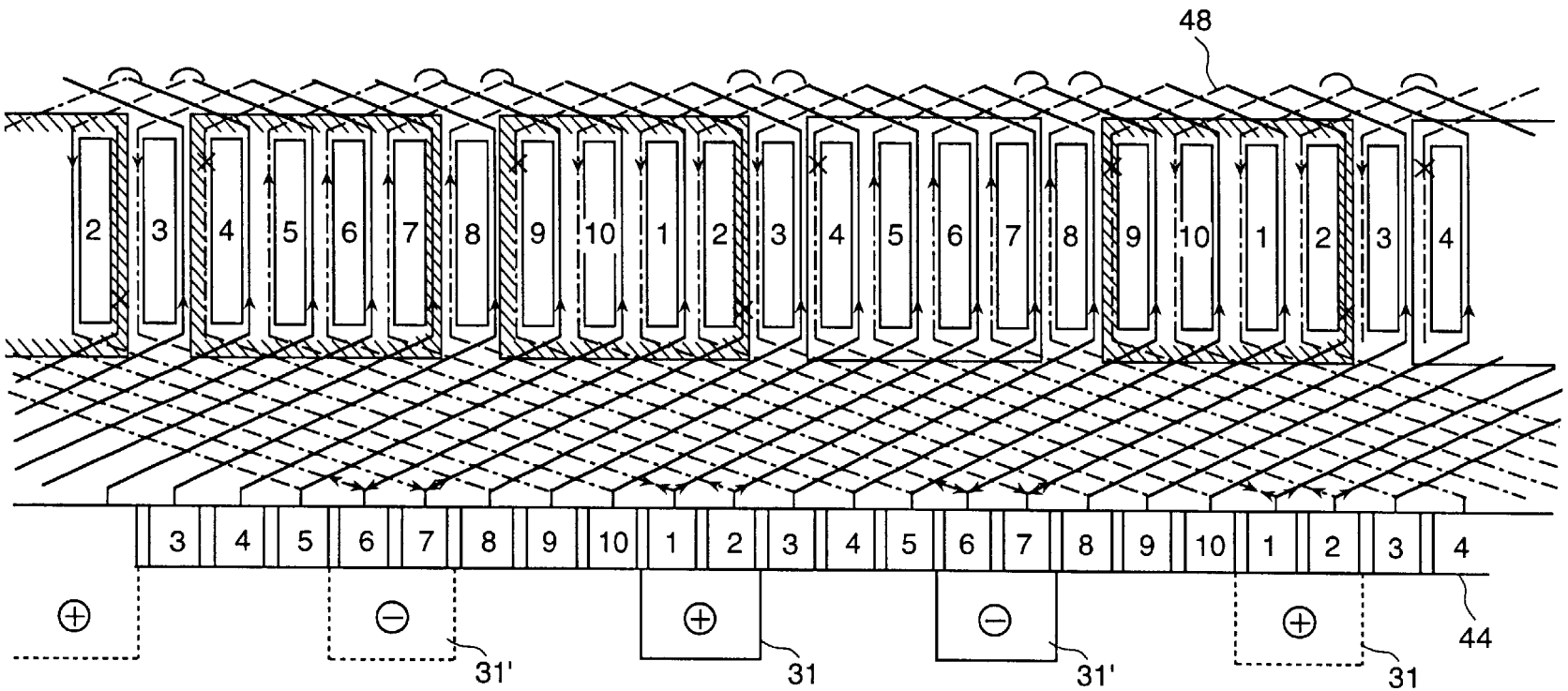
FIG. 12 is a wire-connection diagram in an armature in the composition where the number of slots is ten, wherein respective brushes are located in the 180° opposed placement, and the ratio b/c>1.
Figure 13:
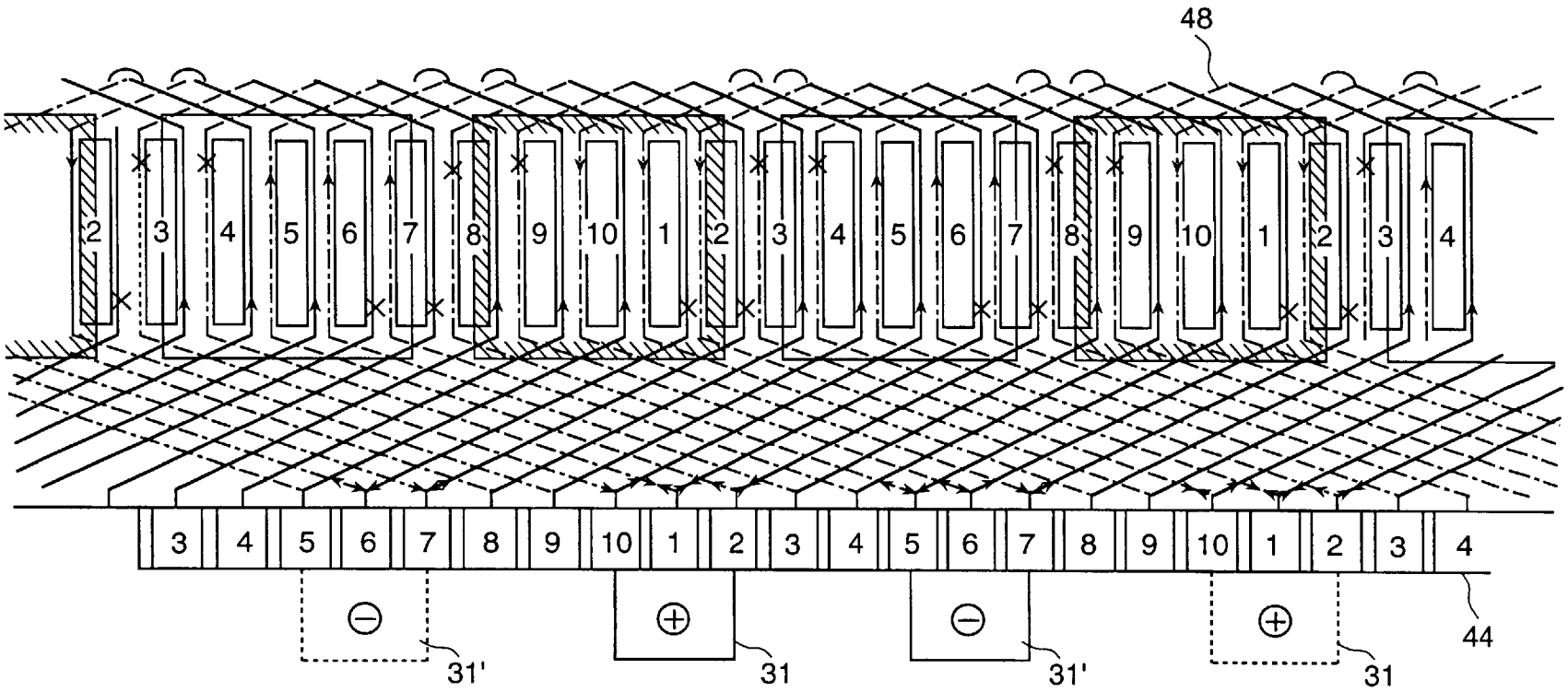
FIG. 13 is a wire-connection diagram in the armature when each brush shorts the neighboring two slots in the composition shown in FIG. 12.
Figure 19:
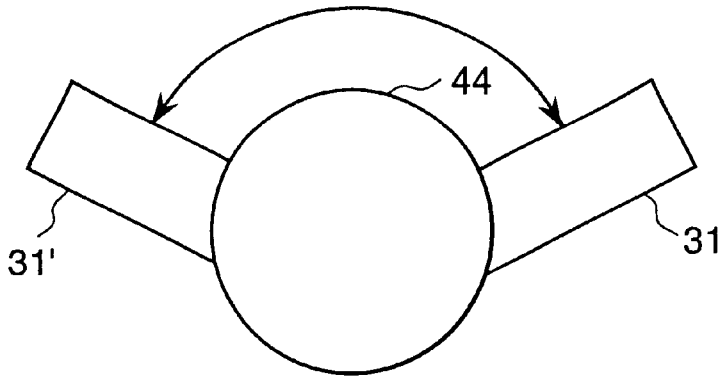
FIG. 19 is an illustration showing the (180–360/2n)° non-opposed placement of the brushes.
Figure 20:
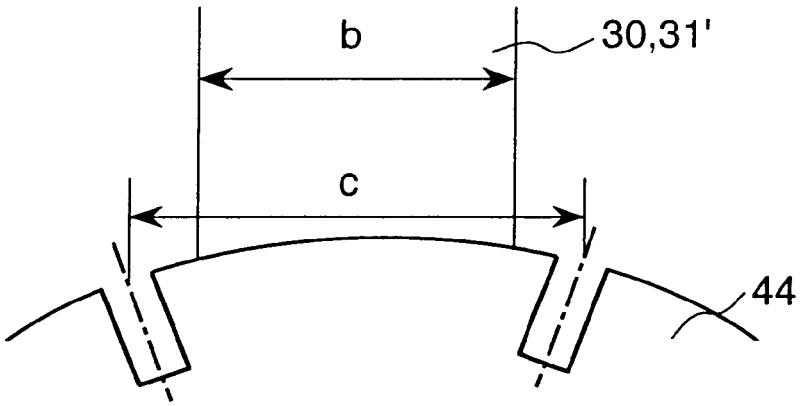
FIG. 20 is an illustration showing the placement in which the ratio b/c<1.
Figure 21:
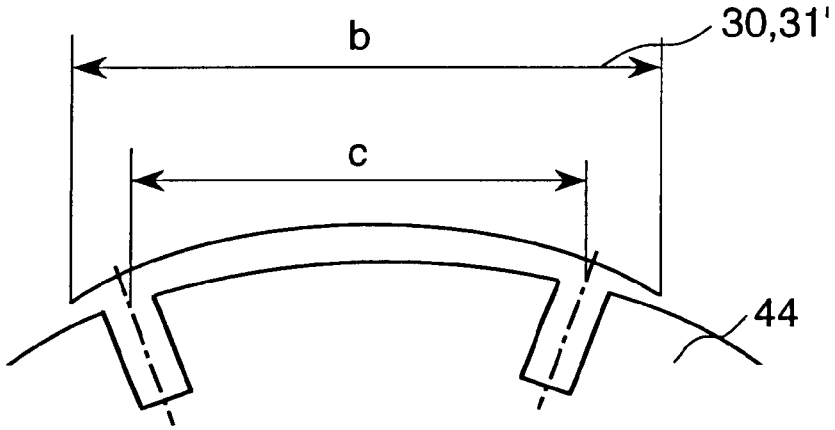
FIG. 21 is an illustration showing the placement in which the ratio b/c>1.

Next, the width of each brush is investigated. Here, adopting a brush with a width b wider than the width c of each slot, such as that shown in FIG. 19, is considered. In such a case, the wire-connection diagrams without and with a short-circuit between two slots are shown in FIG. 12 and FIG. 13. The above composition of the armature with a brush with a width b wider than the width c of each slot is called a covering with the width ratio of more than 1. The covering with the width ratio of more than 1 is not desirable because it causes the number of short-circuits more than that with the width ratio of less than 1, which in turn increases the resistance changes ΔR. The covering with a width ratio of less than 1 should be selected.

Figure 14:
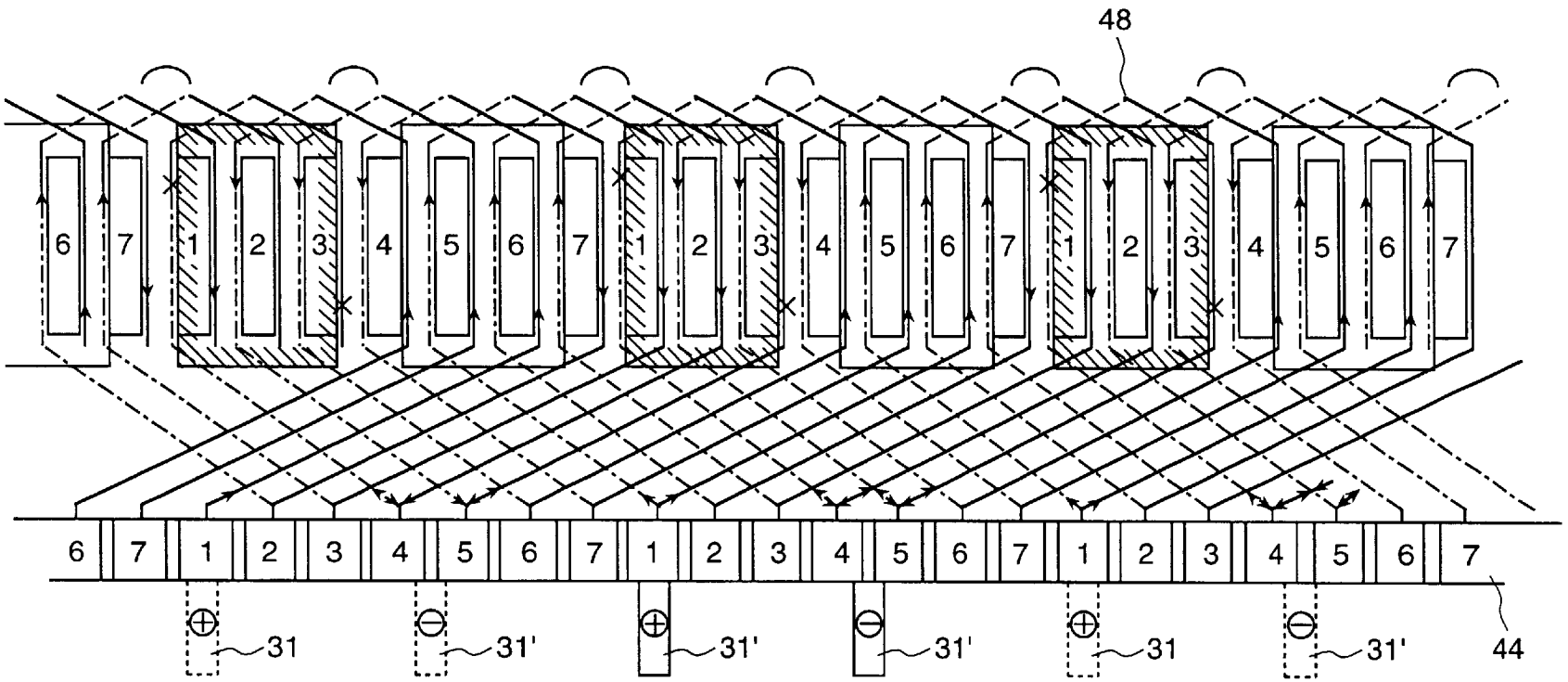
FIG. 14 is a wire-connection diagram in an armature in the composition where the number of slots is seven, and respective brushes are located in the 180° opposed placement.
Figure 15:
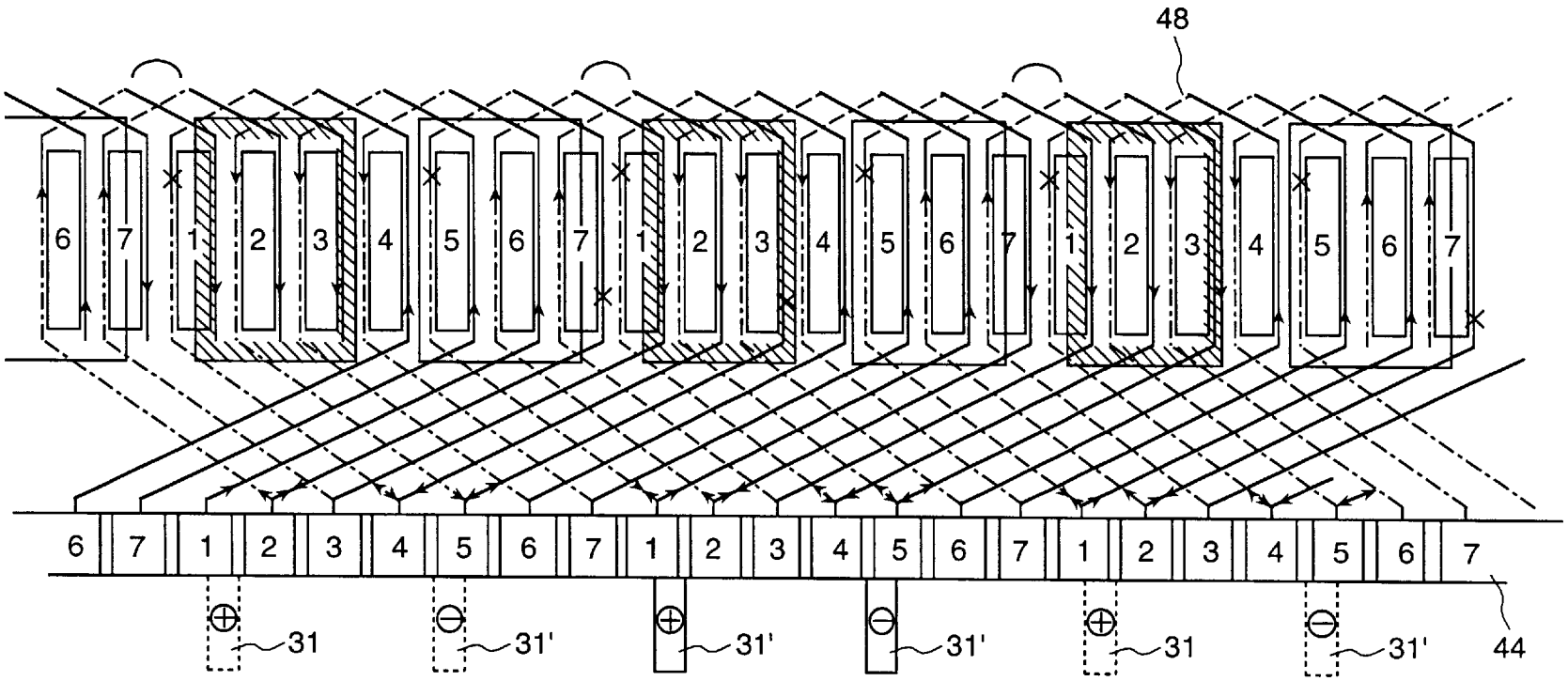
FIG. 15 is a wire-connection diagram in the armature when each brush shorts the neighboring two slots in the composition shown in FIG. 14.
Figure 16:
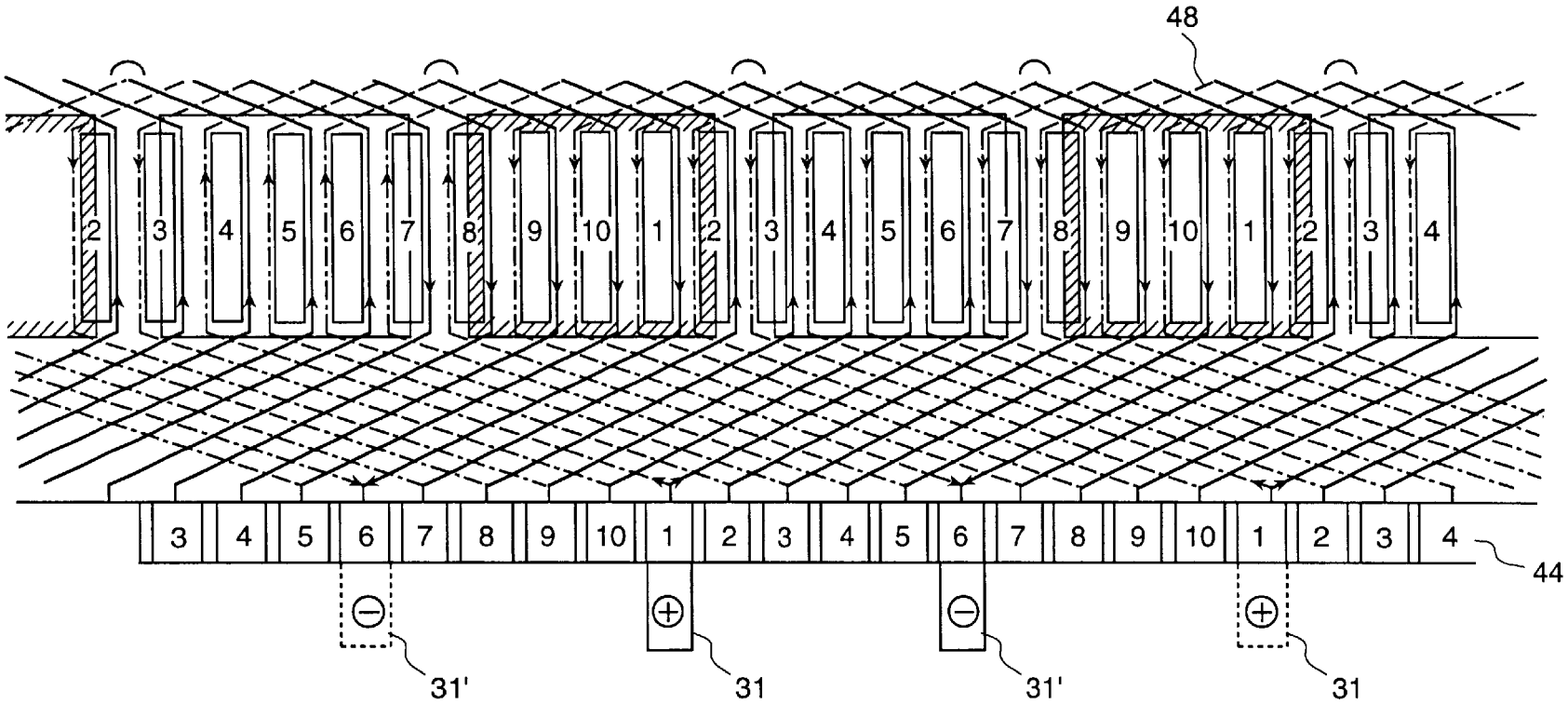
FIG. 16 is a wire-connection diagram in an armature in the composition where the number of slots is nine, and respective brushes are located in the 180° opposed placement.
Figure 17:
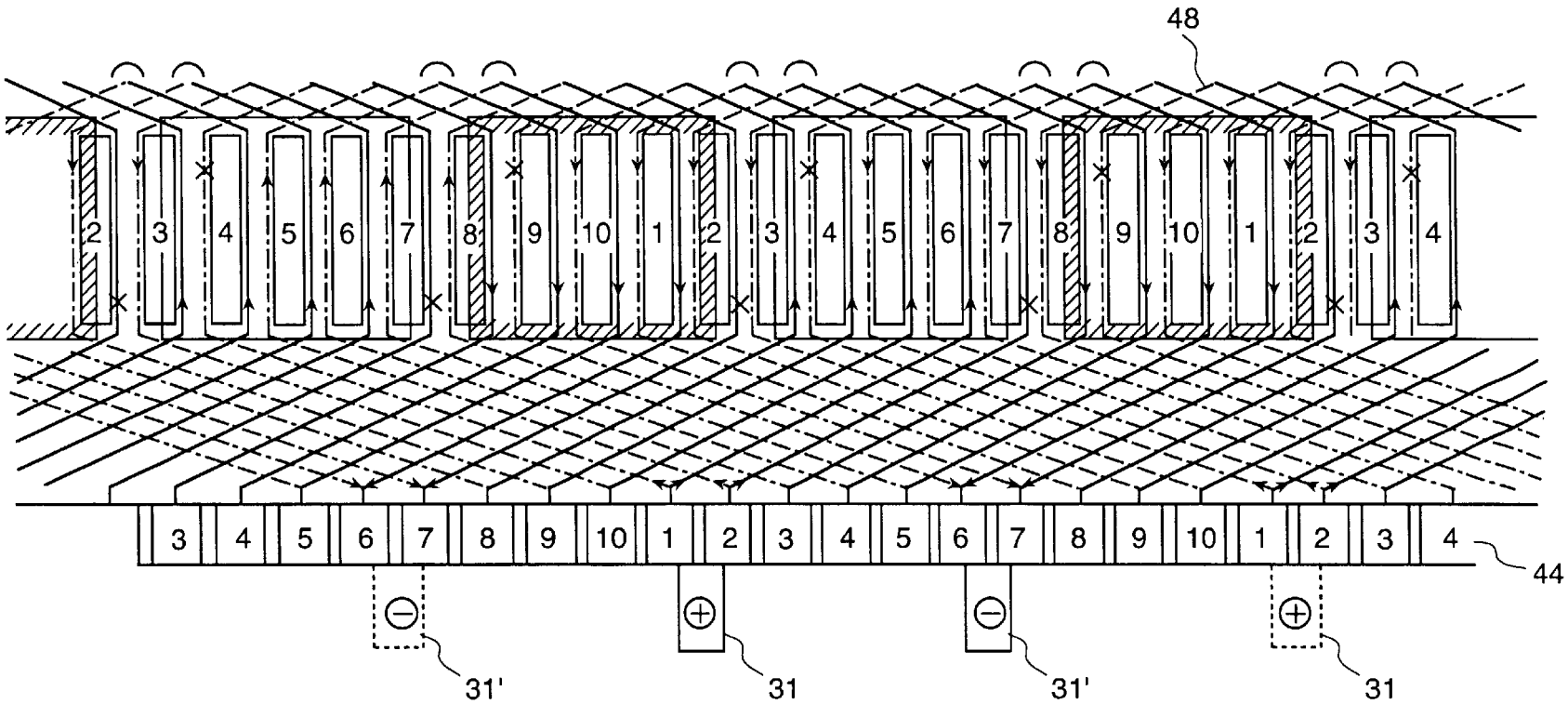
FIG. 17 is a wire-connection diagram in the armature when each brush shorts the neighboring two slots in the composition shown in FIG. 16.

For comparing two cases in which the slot numbers of 7 and 10 are adopted, respectively, in the same 180° opposed placement of the brushes 44, the respective wire-connection diagrams without a short-circuit and with short-circuits in the case in which the slot number 7 is adopted, are shown in FIGS. 14 and 15, and the respective wire-connection diagrams without a short-circuit and with short-circuits in the case in which the slot number 7 is adopted, are shown in FIGS. 16 and 17.

The relative variation values of torque, that is: ΔT/Tnom, where Tnom: a torque in a steady state, were obtained by the inventors as shown in Table 2.

TABLE 2

(The relative variation of torque)

| The number of slots | ΔT/Tnom (%) The brush placement: (180–360/2n)° placement |
|---|---|
| 6 | 11.1 |
| 8 | 7.69 |
| 10 | 5.88 |
| 12 | 4.76 |

Even if the number of the slots is even, since the wire-connection pattern similar to that in the cases in which the odd slot number is adopted appears, the fluctuations of the rotational speed can be suppressed as seen from the above table. However, the composition in which the slot number is 6, must be omitted.

Table 1 and Table 2 are summarized into Table 3.

From the results shown in Table 3, it has been found that the following countermeasures (1)–(8) are effective to suppress the fluctuation of engine rotational-speed to within 3%.

TABLE 3

| The number of slots | ΔT/Tnom (%) 180° opposed-placement | (180–360/2n)° placement |
|---|---|---|
| 6 | 20.0 | 11.11 |
| 7 | 6.67 | — |
| 8 | 14.29 | 7.69 |
| 9 | 5.26 | — |
| 10 | 11.11 | 5.88 |
| 11 | 4.35 | — |
| 12 | 9.09 | 4.76 |
| 13 | 4.00 | — |

(1) To provide a first electric throttle-control apparatus, which includes a motor, a speed-reduction mechanism for reducing rotational speed of the motor, and a throttle valve connected to the speed-reduction mechanism, for controlling an open position of the throttle valve by driving the motor, wherein the motor includes a commutator with a plurality of slots, and brushes; and the number of the slots in the commutator and the arrangement of brushes on the slots are set such that even and odd number slot states appear alternately in an electrical equivalent-circuit of a wire-connection among slots including the brushes while the motor rotates.

(2) to provide an electric throttle-control apparatus such that, in the above first electric throttle-control apparatus, the number of the slots of the commutator is one of odd numbers 9, 11, and 13; the number of the brushes is 2; and the brushes are arranged in a 180° opposed placement.

(3) It is most desirable to provide an electric throttle-control apparatus such that, in the above electric throttle-control apparatus, the number of the slots of the commutator is one of odd numbers 9 and 11.

(4) To provide an electric throttle-control apparatus such that, in the above first electric throttle-control apparatus, the number of the slots of the commutator is one of even numbers 10 and 12; the number of the brushes is 2; and the brushes are arranged in a non-opposed placement shifted from a 180° opposed placement.

(5) It is most desirable to provide an electric throttle-control apparatus such that, in the above electric throttle-control apparatus, the number of the slots of the commutator is 10.

(6) To provide an electric throttle-control apparatus such that, in the above first electric throttle-control apparatus, the number of the slots of the commutator is one of even numbers 10 and 12; the number of the brushes is 2; and the brushes are arranged in a (180–360/2n)° non-opposed placement, where n is the number of the slots of the commutator.

(7) To provide an electric throttle-control apparatus such that, in the above electric throttle-control apparatuses, representing the width of each brush and the peripheral pitch between slots with symbols b and c, respectively, the ratio b/c is set to a value equal to or less than 1.

(8) To provide an electric throttle-control apparatus, including a commutator with a plurality of slots, and brushes, wherein a relative variation of engine rotational-speed is suppressed to within 3% by setting the number of the slots in the commutator and the arrangement of brushes on the slots such that even and odd number slot states appear alternately in an electrical equivalent-circuit of a wire-connection among slots including the brushes while the motor rotates.

FIG. 24 shows electrical equivalent-circuits of respective armatures in the 180° opposed placement and (180–360/2n)° non-opposed placement of the brushes; and further in states with or without each brushes straddle between slots, corresponding to a varying number of slots. In the state without each brush's straddle between slots, each brush does not straddle any two neighboring slots, and contacts only one slot. On the other hand, in the state with each brush's straddle between slots, each brush straddles any two neighboring slots, and shorts the slots.

As seen from FIG. 24, if the slot number is 9, 11, or 13, the slot number in the electrical equivalent-circuit of each armature becomes the even number of 8, 10, or 12 in the state with each brush's straddle between two slots, respectively. On the other hand, if the slot number is 8, 10, or 12, the slot number in the electrical equivalent-circuit of each armature becomes the odd number of 7, 9, or 11 in the state with each brush's straddle between slots, respectively. The case in which the slot number is 8 (the slot number in the electrical equivalent-circuit being 7) is omitted because this case does not satisfy the requirement of fluctuations in rotational speed to be within 3% as mentioned previously. Accordingly, if the even slot number is adopted, the slot number of 10 or 12 must be selected with brushes arranged in the non-opposed placement.

Figure 25A:
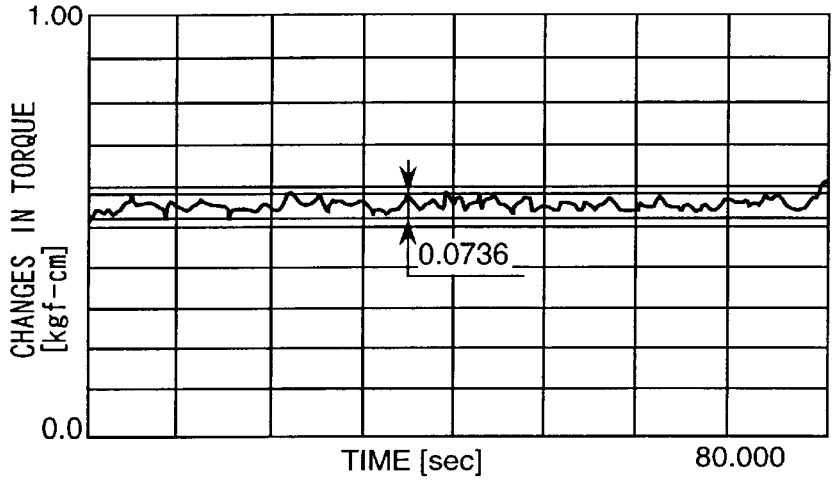
FIGS. 25A–25C are graphs showing fluctuations in torque of respective motors under the various conditions of their respective composition.
Figure 25B:
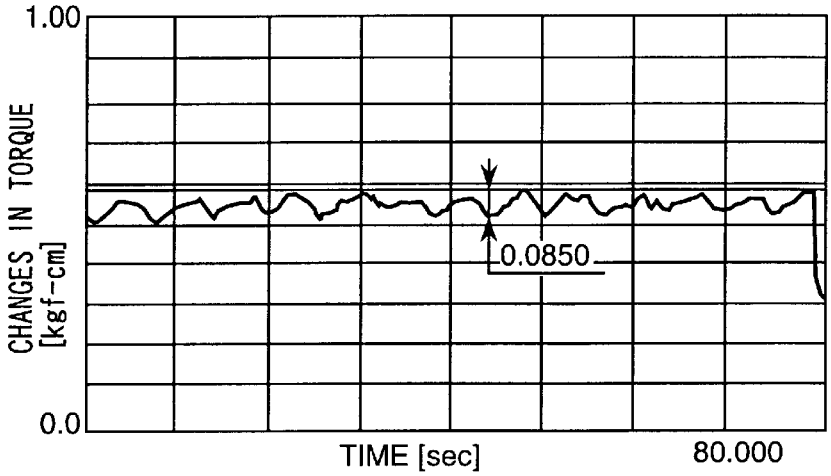
Figure 25C:
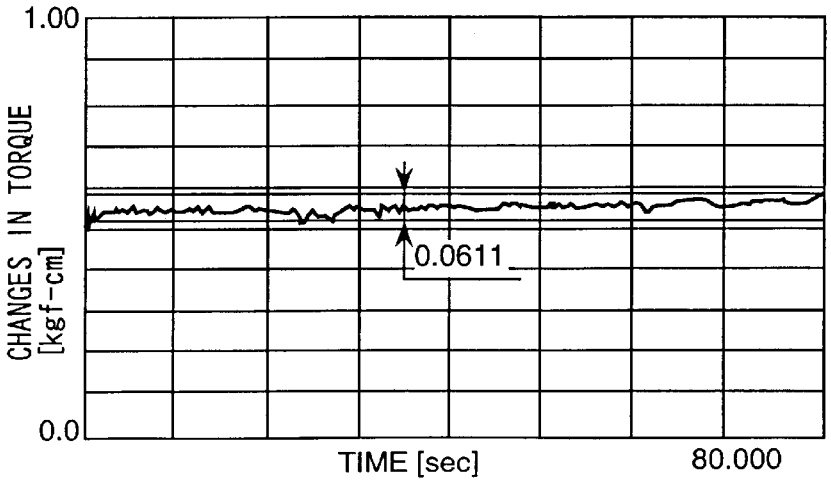
Figure 26:
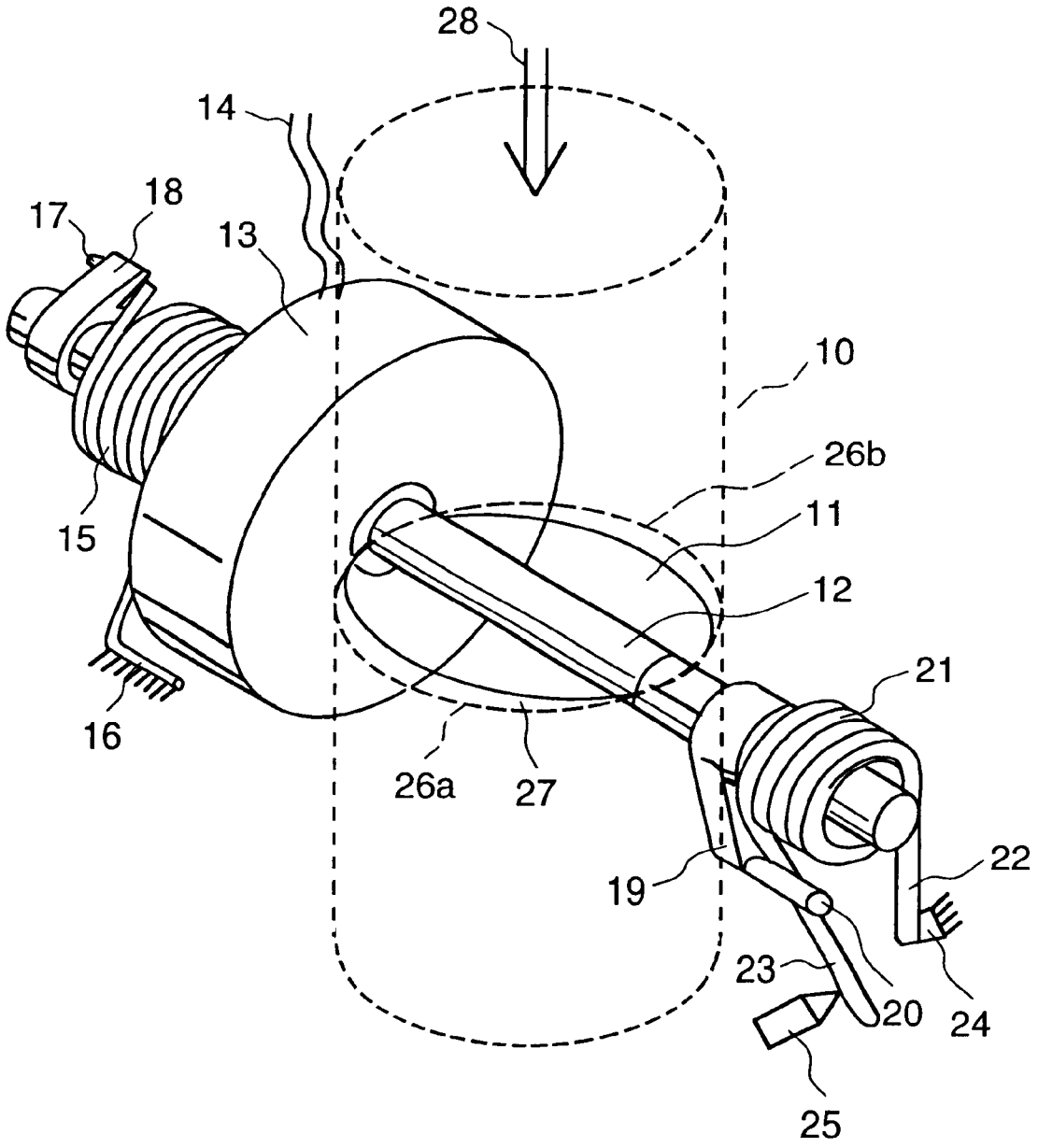
FIG. 26 PRIOR ART
FIG. 26 is a perspective view of a conventional electric throttle-control apparatus.
Figure 27:
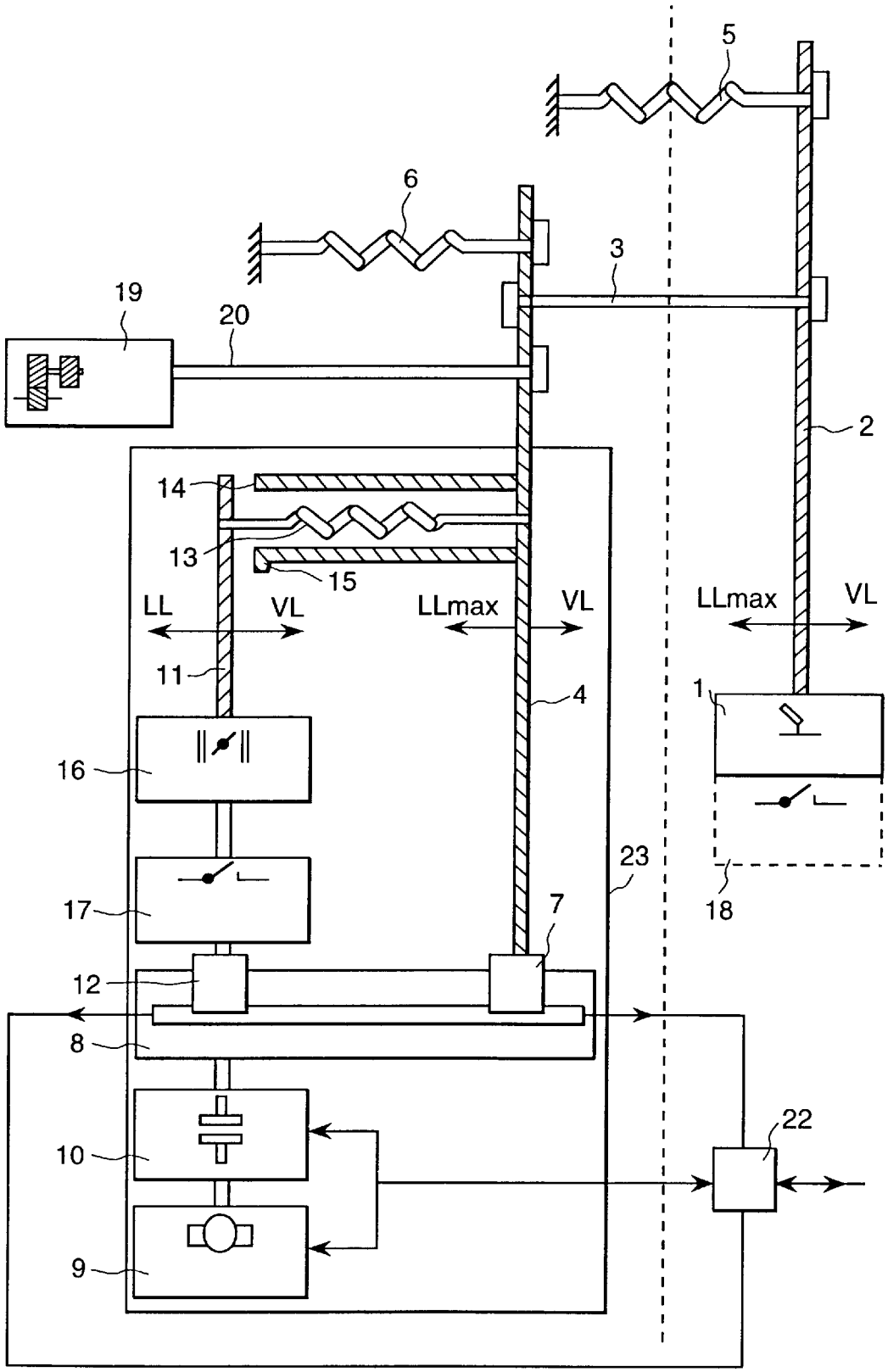
FIG. 27 PRIOR ART
FIG. 27 is a diagram showing a schematic composition of another conventional electric throttle-control apparatus.

FIGS. 25A–25C are graphs showing fluctuations in torque of respective motors in three types of compositions. These three types of compositions corresponding to FIGS. 25A–25C are those with the slot number of 7 and the 180° opposed placement of the brushes, the slot number of 10 and the 180° opposed placement of the brushes, and the slot number of 10 and the non-opposed placement of the brushes, respectively. In both the cases shown in FIG. 25A and FIG. 25B, the changes in the average torque are almost the same, but the fluctuations of rotational speed exceed the level of 3%. The torque change between slots is reduced, which in turn decreases the change in average torque of the motor. It is because the even and odd slot numbers in the electrical equivalent-circuit of the armature appear alternately according to the relative position between each brush and the slots during rotation of the motor in the above composition concerning the slot number and the placement of the brushes.

As mentioned above, in accordance with the present invention, by providing only a motor with a simple composition, the relative variation of torque in each brush's transition between slots can be suppressed below a low level, which in turn can also suppress the change in average torque, and decrease the change ΔIa in current. Thus, since the fluctuations of the engine rotational-speed can be reduced to within 3%, the reduced fluctuation of the rotational speed does not bring visual and audible uneasy feelings to a driver. Further, by replacing a pair of brushes, it is possible to provide a motor which is not constrained by its control specification. Furthermore, by applying the electric throttle-control apparatus according to the present invention to an internal combustion engine with a throttle valve, it is possible to provide an internal combustion engine with an excellent running performance.

What is claimed is:

1. An electric throttle-control apparatus, which includes a motor, a speed-reduction mechanism for reducing rotational speed of said motor, and a throttle valve connected to said speed-reduction mechanism, for controlling an open position of said throttle valve by driving said motor, wherein said motor includes a commutator with a plurality of slots, and brushes; and the number of said slots in said commutator and the arrangement of brushes on said slots are set such that even and odd number slot states appear alternately in an electrical equivalent-circuit of a wire-connection among slots including said brushes while said motor rotates.

2. An electric throttle-control apparatus according to claim 1, wherein the number of said slots of said commutator is one of odd numbers 9, 11, and 13; the number of said brushes is 2; and said brushes are arranged in a 180° opposed placement.

3. An electric throttle-control apparatus according to claim 2, wherein the number of said slots of said commutator is one of odd numbers 9 and 11.

4. An electric throttle-control apparatus according to claim 1, wherein the number of said slots of said commutator is one of even numbers 10 and 12; the number of said brushes is 2; and said brushes are arranged by shifting their positions from a 180° opposed placement.

5. An electric throttle-control apparatus according to claim 4, wherein said brushes are arranged in a (180–360/2n)° non-opposed placement, where n is the number of said slots of said commutator.

6. An electric throttle-control apparatus according to claim 5, wherein brush holders for holding said respective slots are arranged in a 180° opposed placement.

7. An electric throttle-control apparatus according to claim 1, wherein, representing the width of each brush and the peripheral pitch between slots with symbols b and c, respectively, the ratio b/c is set to a value equal to or less than 1.

8. An internal combustion engine using an electric throttle-control apparatus according to claim 1.

9. An electric throttle-control apparatus, which includes a motor, a speed-reduction mechanism for reducing rotational speed of said motor, and a throttle valve connected to said speed-reduction mechanism, for controlling an open position of said throttle valve by driving said motor, wherein said motor includes a commutator with a plurality of slots, and two brushes; and a relative variation of engine rotational-speed is suppressed to within 3% by setting the number of said slots to one of odd numbers 9, 11, and 13, and arranging said two brushes in a 180° opposed placement.

10. An electric throttle-control apparatus, which includes a motor, a speed-reduction mechanism for reducing rotational speed of said motor, and a throttle valve connected to said speed-reduction mechanism, for controlling an open position of said throttle valve by driving said motor, wherein said motor includes a commutator with a plurality of slots, and two brushes; and a relative variation of engine rotational-speed is suppressed to within 3% by setting the number of said slots to one of even numbers 10 and 12, and arranging said two brushes in a non-opposed placement shifted from a 180° opposed placement.

11. A motor used for an electric throttle-control apparatus, including a commutator with a plurality of slots, and two brushes, wherein a relative variation of engine rotational-speed is suppressed to within 3% by setting the number of said slots to one of odd numbers 9, 11, and 13, and arranging said two brushes in a 180° opposed placement.

12. A motor according to claim 11, wherein the number of said slots is one of odd numbers 9 and 11.

13. An internal combustion engine including an electric throttle-control apparatus in which a motor, according to claim 11, is used.

14. A motor used for an electric throttle-control apparatus, including a commutator with a plurality of slots, and two brushes, wherein a relative variation of engine rotational-speed is suppressed to within 3% by setting the number of said slots to one of even numbers 10 and 12; and said two brushes are arranged in a non-opposed placement shifted from a 180° opposed placement.

* * * * *